US008146201B2

(12) United States Patent
Conrad

(10) Patent No.: US 8,146,201 B2
(45) Date of Patent: Apr. 3, 2012

(54) SURFACE CLEANING APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 150 days.

(21) Appl. No.: 11/828,694

(22) Filed: Jul. 26, 2007

(65) Prior Publication Data

US 2008/0134460 A1 Jun. 12, 2008

Related U.S. Application Data

(60) Provisional application No. 60/869,586, filed on Dec. 12, 2006, provisional application No. 60/870,175, filed on Dec. 15, 2006, provisional application No. 60/884,767, filed on Jan. 12, 2007, provisional application No. 60/893,990, filed on Mar. 9, 2007.

(51) Int. Cl.
*A47L 9/10* (2006.01)

(52) U.S. Cl. ..... 15/353; 15/327.7; 15/347; 15/412

(58) Field of Classification Search ..... 15/327.7, 15/347, 353, 412
See application file for complete search history.

(56) References Cited

U.S. PATENT DOCUMENTS

| | | | | |
|---|---|---|---|---|
| 3,320,727 | A * | 5/1967 | Farley et al. | 55/337 |
| 3,822,533 | A | 7/1974 | Oranje | |
| 3,877,902 | A | 4/1975 | Eriksson et al. | |
| 4,187,088 | A | 2/1980 | Hodgson | |
| 5,129,125 | A | 7/1992 | Gamou et al. | |
| 5,135,552 | A | 8/1992 | Weistra | |
| 5,267,371 | A | 12/1993 | Soler et al. | |
| 5,779,744 | A | 7/1998 | Mueller et al. | |
| 6,145,160 | A * | 11/2000 | Buss et al. | 15/323 |
| 6,406,505 | B1 | 6/2002 | Oh et al. | |
| 6,810,558 | B2 | 11/2004 | Lee | |
| 6,840,972 | B1 | 1/2005 | Kim | |
| 7,278,180 | B2 * | 10/2007 | Pyeong | 15/412 |
| 7,377,007 | B2 * | 5/2008 | Best | 15/329 |
| 7,488,362 | B2 | 2/2009 | Jeong et al. | |
| 7,488,363 | B2 | 2/2009 | Jeong et al. | |
| 7,547,337 | B2 * | 6/2009 | Oh et al. | 55/345 |
| 7,556,661 | B2 | 7/2009 | Jeong et al. | |
| 7,604,675 | B2 | 10/2009 | Makarov et al. | |
| 2004/0083694 | A1 | 5/2004 | Choi | |
| 2004/0134022 | A1 | 7/2004 | Murphy et al. | |
| 2005/0138758 | A1 | 6/2005 | Lee et al. | |
| 2006/0042039 | A1 * | 3/2006 | McDowell et al. | 15/353 |
| 2006/0090428 | A1 | 5/2006 | Park et al. | |

(Continued)

FOREIGN PATENT DOCUMENTS

EP 0489468 A1 6/1992

(Continued)

OTHER PUBLICATIONS

Office Action issued on co-pending U.S. Appl. No. 11/952,420, mailed on Jun. 21, 2010.

(Continued)

*Primary Examiner* — Joseph J Hail
*Assistant Examiner* — Shantese McDonald
(74) *Attorney, Agent, or Firm* — Bereskin & Parr LLP; Philip C. Mendes da Costa

(57) ABSTRACT

A vacuum cleaner comprises adjacent housings, which contain the filtration and suction fan motor assembly of the vacuum cleaner.

39 Claims, 19 Drawing Sheets

U.S. PATENT DOCUMENTS

| | | | | |
|---|---|---|---|---|
| 2006/0101610 | A1 | 5/2006 | Oh et al. | |
| 2006/0137303 | A1* | 6/2006 | Jeong et al. | 55/337 |
| 2006/0137304 | A1 | 6/2006 | Jeong et al. | |
| 2006/0137307 | A1 | 6/2006 | Jeong et al. | |
| 2006/0137309 | A1 | 6/2006 | Jeong et al. | |
| 2006/0277712 | A1* | 12/2006 | Kim et al. | 15/353 |
| 2007/0130895 | A1 | 6/2007 | Boeck et al. | |
| 2007/0143953 | A1 | 6/2007 | Hwang et al. | |
| 2007/0289267 | A1 | 12/2007 | Makarov et al. | |

FOREIGN PATENT DOCUMENTS

| | | | |
|---|---|---|---|
| EP | 1302148 | A2 | 4/2003 |
| EP | 1323370 | A2 | 7/2003 |
| GB | 2365324 | A | 2/2002 |
| GB | 2440111 | A | 1/2008 |
| GB | 2457419 | A | 8/2009 |
| JP | 2003-33300 | A | 2/2003 |

OTHER PUBLICATIONS

International Preliminary Report on Patentability received on the co-pending international application No. PCT/CA2007/002205, dated Jun. 16, 2009.

International Preliminary Report on Patentability received on the corresponding international application No. PCT/CA2007/002204, dated Apr. 24, 2008.

Third party observations made of record on the related United Kingdom Application No. 0911652.6, mailed on Jul. 14, 2010.

* cited by examiner

SURFACE CLEANING APPARATUS

FIELD OF THE INVENTION

This application relates to surface cleaning apparatus that have adjacent housings. Preferably, one of the housings contains a cyclonic cleaning stage and a second housing has a suction motor. This application also relates to surface cleaning apparatus that may be carried by a strap (i.e., strap carriable), such as a shoulder strap or a waist strap and, preferably, strap carriable vacuum cleaners, which utilize a cyclone.

BACKGROUND OF THE INVENTION

Cyclonic vacuum cleaners have been developed that utilize one or more cyclonic cleaning stages. Each cyclonic cleaning stage may have its own dirt collection chamber. Cyclonic vacuum cleaner that have a cyclonic cleaning stage comprising a plurality of cyclones in parallel are also known. Such cleaning stages may have a dirt collection chamber for each cyclone, or a single common dirt collection chamber for all of the cyclones in the stage. In all such cases, the frequency with which the vacuum cleaner must be emptied is based on the capacity of the dirt collection chamber.

Various types of vacuum cleaners are known in the art. The vacuum cleaner that may be selected for a particular application will vary depending upon a number of factors. For example, vacuum cleaners that are used for cleaning an office or a residence require a large capacity dirt container and maneuverability. In order to increase the dirt capacity of a vacuum cleaner, the size of the dirt collection receptacle must be increased. Increasing the size of the dirt collection receptacle may result in the overall size of the vacuum cleaner being increased to such an extent that the maneuverability of the vacuum cleaner decreases.

SUMMARY OF THE INVENTION

In accordance with the instant invention, a surface cleaning apparatus, preferably a vacuum cleaner, is provided with at least two adjacent or side-by-side housings wherein one of the housings includes at least one cyclone and the other includes a suction motor. "Side-by-side" is used to refer to housings that extend in the same generally direction (e.g., they may each have a linear axis wherein the axis are generally parallel) such that the lateral displacement of the bottoms of the first and second housings is approximately the same as the lateral displacement of the tops of the first and second housings. Preferably, if the axis are not parallel and accordingly they intersect, the angle between adjacent linear axis is less than 20 degrees, preferably less than 10 degrees and most preferably, they are parallel.

The use of adjacent housings to contain part or all of the air cleaning members of a surface cleaning apparatus and the suction motor permits the surface cleaning apparatus to be more compact. For example, upright vacuum cleaners typically have the air-cleaning members and suction motor positioned one above the other. Therefore, the height, or the linear length, of these components is relatively large. The height of the surface cleaning apparatus may be reduced by having units positioned side-by-side as opposed to stacked or linearly extending as is known in the art. Alternately, or in addition, the length of a cyclone may be increased without increasing the overall height or linear extent of a surface cleaning apparatus.

Accordingly, the overall height of the surface cleaning apparatus may be reduced by effectively increasing the width of the surface cleaning apparatus. For example, if the two housings are each cylindrical, then the width of the surface cleaning apparatus (from one side of the first housing to the other side of the second housing) equal to the sum of the diameter of each of the two housings.

Further, by providing housings that are generally parallel, the centre of gravity of the housings is positioned more centrally, thereby increasing the maneuverability of the surface cleaning apparatus, particularly if it is designed to be used while being carried (e.g., strap carriable).

Preferably, the surface cleaning apparatus is a portable surface cleaning apparatus, such as a hand vacuum cleaner and a strap carriable vacuum cleaner. However, in an alternate embodiment, the surface cleaning apparatus may be mounted on wheels. For example, the surface cleaning apparatus may be a wet/dry vacuum cleaner, which is also known as Shop Vac™ vacuum cleaners.

It will be appreciated that more than two side-by-side housings may be used. Preferably, each housing is circular in cross section (e.g., cylindrical or conical). However, any shape may be utilized.

The two housings may be positioned so that they touch or they may be proximate each other.

The air may enter the first housing, which houses a first cyclonic stage comprising at least one cyclone, and then travels to the second housing, which houses the suction motor and fan assembly. The first housing may contain a plurality of cyclone stages. Each cyclone stage may contain one cyclone or a plurality of cyclones in parallel. In a particularly preferred embodiment, only a single cyclone is provided in the first housing. In another particularly preferred embodiment, a second cyclonic stage is provided which comprises a plurality of cyclones in parallel. This second cyclonic stage is preferably positioned in the first housing and, more preferably, above the first cyclonic stage.

The second housing may contain a pre-motor and/or a post-motor filter. A screen or the like may be associated with the air outlet from the cyclone to prevent elongate material, such as hair, from passing downstream from the cyclone towards the motor.

In one aspect, a strap carriable vacuum cleaner of this general construction may have a plate positioned towards the bottom of the cyclone so as to essentially divide the cyclone into an upper cyclone chamber (i.e. in the portion of the housing above the plate) and a lower dirt container (i.e. in the portion of the housing below the plate).

In a particularly preferred embodiment of this aspect, the bottom of the first housing may be pivotally mounted for opening. Accordingly, when a user is carrying a strap carriable vacuum cleaner on the user's shoulder, the bottom of the first housing may be opened while the user is standing beside a garbage receptacle (e.g. a garbage bin). Accordingly, the dirt may be emptied directly from the cyclone housing into the garbage bin. An advantage of this design with a strap carriable vacuum cleaner is that the user may have both hands available for manipulating the vacuum cleaner without having to support any weight of the vacuum cleaner in the user's hands since the weight of the vacuum cleaner will be borne by the shoulder of the user.

In a second aspect, the upper portions of the first and second housings may be covered by an openable lid. Accordingly, for example, a plenum for connecting the first housing in airflow communication with the second housing may be defined by the volume between the inside of the lid and the upper portions of the first and second housings. Preferably, the first and second housings may have a common lid, which is openable. However, it will be appreciated that each housing may have a separate lid that are connected together when both lids are closed. Preferably, the lid is pivotally connected to the first and second housings. However, the lid may be removably mounted. When the lid is opened, a user is provided access to the top of the first housing and the top of the second housing. Accordingly, a user may clean any debris that accumulates in the plenum. Further, if a screen is associated with the cyclone outlet for preventing hair or the like from passing downstream to the suction motor and fan assembly, the user may remove the screen from the first housing for cleaning. In addition, if a pre-motor filter is positioned in the second housing, the user may remove the pre-motor filter for cleaning. It will be appreciated that in some designs each aspect may be used separately and, in other designs, both may be utilized.

Alternately, or in addition to one or both aspects, the first housing (which contains the cyclone) is preferably fixed to the strap carriable vacuum cleaner. Since the first housing does not have to be removed from the vacuum cleaner to empty the dirt chamber of the cyclone, then the overall strength of the vacuum cleaner is enhanced by providing the first housing such that it forms a structural part of the vacuum cleaner. For example, it may be non-removably secured to the vacuum cleaner (e.g., an adhesive, welding) or it may be removably mounted (e.g., a bayonet mount, screws).

Alternately, or in addition to any embodiment or aspect, it is preferred that the cyclone does not have a porous member, e.g. a fluff screen of filter in the cyclone chamber. Such items, even if accessible, can be difficult to remove without the user getting their hands dirty. In accordance with this embodiment, any such screen or filter may be provided in or adjacent to the plenum.

Alternately, or in addition to any embodiment or aspect, one or more screens and/or filters may be provided in a housing wherein the housing has one or more handles. Therefore, a user need not touch the screen and/or filter to remove it from the vacuum cleaner.

Alternately, or in addition to any embodiment or aspect, the strap carriable vacuum cleaner may use a single cyclone, and the cyclone (the cyclone chamber and the dirt container combined) comprises at least 40%, preferably at least 50% and more preferably at least 60% of the should strap vacuum cleaner (i.e. of the first and second housings, or more housings if provided) without an optional wheeled base from and the suction hose that is connected to the inlet to the cyclone chamber. In an alternate embodiment, the vacuum cleaner has at least two cyclones and the combined volume of the cyclones comprises at least 40%, preferably at least 50% and more preferably at least 60% of the should strap vacuum cleaner.

Alternately, or in addition to any embodiment or aspect, the vacuum cleaner has a first stage cyclone that has an efficiency of 95% or more of IEC™ test dust (i.e., it separates 95% or more of IEC™ test dust that is fed to the cyclone) and has 50 air watts or more at the cyclone inlet.

The vacuum cleaner may weight less then 10 pounds, preferably less than 8 pounds and more preferably less then 6 pounds, without the cord, yet have more than 25 air watts.

Alternately, or in addition to any embodiment or aspect, the electrical cord is removably mounted to the vacuum cleaner. Alternately, or in addition, the vacuum cleaner may include one or more batteries such that the vacuum cleaner may be operated on household AC current and also on DC power from the batteries (e.g., if the cord is removed or wound on a reel to increase maneuverability).

In any embodiment, the vacuum cleaner may be provided with wheels, such that it could be used optionally as a canister vacuum cleaner. The wheels may be detachable, e.g., the vacuum cleaner may be removably mounted on a wheeled base.

In any embodiment, the vacuum cleaner may be provided with a waist strap, which may be used in lieu of or in addition to the shoulder strap.

In accordance with one aspect, there is provided a surface cleaning apparatus comprising:

(a) a dirt air inlet and a cleaned air outlet and a fluid flow path extending therebetween; and, (b) first and second housings positioned side by side, the first housing comprises at least one cyclone and has an exterior wall and the second housing comprises a suction motor wherein the at least one cyclone and the suction motor are part of the fluid flow path.

In one embodiment, the first and second housings are secured together, such as by an adhesive, welding, or mechanical means, such as screws. Preferably, the first and second housings are integrally molded.

In another embodiment, the first and second housings are constructed from a transparent plastic. It will be appreciated that only part or all of the cyclone may be transparent, or the dirt chamber therefore. However, if the first and second housings are integrally formed, then both housing are preferably transparent.

In another embodiment, the exterior wall of the at least one cyclone forms at least a portion of the exterior wall of the first housing. Preferably, the exterior walls of the first and second housing form exterior walls of the surface cleaning apparatus. However, in an optional embodiment, an exterior casing may surround part or all of the first and second housings.

In another embodiment, the surface cleaning apparatus is portable and further comprises a flexible hose positioned between a cleaning tool having the dirt inlet and the first housing and at least one of a strap and a handle.

In another embodiment, the strap comprises at least one of a shoulder strap and a waist strap.

In another embodiment, the surface cleaning apparatus further comprises a rigid conduit extending between the cleaning tool and the flexible hose, the rigid conduit having a handle.

In another embodiment, the second housing includes at least one filter positioned upstream from the suction motor.

In another embodiment, the filter is mounted in a filter housing and the housing is removable provided in the second housing and has handles.

In another embodiment, each housing has an upper portion, an air flow passage is provided from the first housing to the second housing and at least one openable lid is provided on the upper portions, whereby, when the lid is opened, the filter is visible.

In another embodiment, when the lid is opened, the airflow passage is accessible.

In another embodiment, the second housing further comprises a second cyclonic cleaning stage.

In another embodiment, the second cyclonic cleaning stage comprises a plurality of cyclones in parallel.

In another embodiment, each housing has an upper portion, an air flow passage is provided from the first housing to the second housing and at least one openable lid is provided on the upper portions, whereby, when the lid is opened, the airflow passage is accessible.

In another embodiment, the lid has an inner surface and the airflow passage is defined as a volume between the inner surface of the lid and the upper portions of the first and second housings.

In another embodiment, a single lid closes the upper portions.

In another embodiment, the first housing has a bottom and a plate is provided in the first housing above the bottom and the bottom of the first housing is openable.

In another embodiment, the plate is mounted to the bottom.

In another embodiment, the first housing comprises a single cyclone and has a bottom, a plate is provided in the first housing above the bottom and the bottom of the first housing is openable.

In another embodiment, the first and second housings have a volume and the at least one cyclone has a volume that is at least 40% of the volume of the first and second housings.

In another embodiment, the at least one cyclone has a volume that is a least 60% of the volume of the first and second housings.

In another embodiment, the first and second housings are each generally vertically extending.

In another embodiment, each housing has a height and the ratio of height of the first housing to the height of the second housing is from 0.6:1 to 1:0.6.

In another embodiment, each housing has a height and the ratio of height of the first housing to the height of the second housing is from 0.75:1 to 1:0.75.

In another embodiment, each housing has a height and the ratio of height of the first housing to the height of the second housing is from 0.9:1 to 1:0.9.

In accordance with another alternate aspect, there is provided a strap carriable vacuum cleaner comprising:

(a) at least first and second adjacent housings, each housing having an upper portion, the first housing having a bottom, the first and second housings having a volume;

(b) at least one openable lid provided on the upper portions, the lid having an inner surface; and, (c) an air flow passage from the first housing to the second housing and defined as a volume between the inner surface of the lid and the upper portions of the first and second housings, whereby, when the lid is opened, the airflow passage is accessible.

In one embodiment, a single lid closes the upper portions.

In another embodiment, the lid is pivotally mounted.

In another embodiment, the first housing includes a cyclone and the second housing includes a suction motor and fan assembly.

In another embodiment, a plate is provided in the cyclone and the bottom of the first housing is pivotally mounted.

In another embodiment, the plate is mounted to the bottom.

In another embodiment, the first housing comprises a single cyclone.

In another embodiment, the vacuum cleaner has at least one cyclone and the at least one cyclone has a volume that is a least 40% of the volume of the first and second housings.

In another embodiment, the vacuum cleaner has at least one cyclone and the at least one cyclone has a volume that is a least 60% of the volume of the first and second housings.

In another embodiment, the vacuum cleaner has dirt separation efficiency of at least 95% of IEC test dirt and at least 50 air watts at the cyclone inlet.

In another embodiment, the vacuum cleaner has at least one cyclone having a cyclone chamber and a cyclone chamber outlet and air travels from the cyclone chamber to the cyclone chamber outlet without passing through a porous member.

In another embodiment, the second housing includes at least one filter mounted in a filter housing and the housing is removable provided in the second housing and has handles.

In another embodiment, at least one filter is removably mounted in the filter housing.

In accordance with a further alternate aspect there is provided a strap carriable vacuum cleaner comprising at least first and second adjacent housings, each housing having an upper portion, the first housing having a bottom, the first and second housings having a volume, the first housing comprising at least one cyclone and the second housing comprising a suction motor and fan assembly wherein the at least one cyclone has a volume that is a least 40% of the volume of the first and second housings.

In one embodiment, the at least one cyclone has a volume that is a least 50% of the volume of the first and second housings.

In another embodiment, the at least one cyclone has a volume that is a least 60% of the volume of the first and second housings.

In another embodiment, a single lid closes the upper portions.

In another embodiment, the lid is pivotally mounted.

In another embodiment, a plate is provided in the cyclone and the bottom of the first housing is pivotally mounted.

In another embodiment, the plate is mounted to the bottom.

In another embodiment, the first housing comprises a single cyclone.

In another embodiment, the vacuum cleaner has dirt separation efficiency of at least 95% of IEC test dirt and at least 50 air watts at the cyclone inlet.

In another embodiment, the at least one cyclone has a cyclone chamber and a cyclone chamber outlet and air travels from the cyclone chamber to the cyclone chamber outlet without passing through a porous member.

In another embodiment, the second housing includes at least one filter mounted in a filter housing and the housing is removably provided in the second housing and has handles.

In another embodiment, at least one filter is removably mounted in the filter housing.

In accordance with a further alternate aspect, there is provided a strap carriable vacuum cleaner comprising:

(a) at least first and second adjacent housings, each housing having an upper portion, the first housing having a bottom, the first and second housings having a volume, the bottom of the first housing is pivotally mounted, the first housing includes a cyclone and the second housing includes a suction motor and fan assembly;

(b) at least one lid provided on the upper portions, the lid having an inner surface; and, (c) an air flow passage from the first housing to the second housing and defined as a volume between the inner surface of the lid and the upper portions of the first and second housings.

In one embodiment, a single lid closes the upper portions.

In another embodiment, the lid is openable.

In another embodiment, a plate is provided in the cyclone.

In another embodiment, the plate is mounted to the bottom.

In another embodiment, the first housing comprises a single cyclone.

In another embodiment, the vacuum cleaner has at least one cyclone and the at least one cyclone has a volume that is a least 40% of the volume of the first and second housings.

In another embodiment, the vacuum cleaner has at least one cyclone and the at least one cyclone has a volume that is a least 60% of the volume of the first and second housings.

In another embodiment, the vacuum cleaner has dirt separation efficiency of at least 95% of IEC test dirt and at least 50 air watts at the cyclone inlet.

In another embodiment, the vacuum cleaner has at least one cyclone having a cyclone chamber and a cyclone chamber outlet and air travels from the cyclone chamber to the cyclone chamber outlet without passing through a porous member.

In another embodiment, the second housing includes at least one filter mounted in a filter housing and the housing is removable provided in the second housing and has handles.

In another embodiment, at least one filter is removably mounted in the filter housing.

In accordance with a further alternate aspect, there is provided a strap carriable vacuum cleaner comprising:

(a) at least first and second adjacent housings, each housing having an upper portion, the first housing having a bottom and at least one cyclone having a cyclone chamber and a cyclone chamber outlet, the first and second housings having a volume, wherein air travels from the cyclone chamber to the cyclone chamber outlet without passing through a porous member;

(b) at least one lid provided on the upper portions, the lid having an inner surface; and, (c) an air flow passage from the first housing to the second housing and defined as a volume between the inner surface of the lid and the upper portions of the first and second housings.

In one embodiment, a single lid closes the upper portions.

In another embodiment, the lid is openable.

In another embodiment, the second housing includes a suction motor and fan assembly.

In another embodiment, a plate is provided in the cyclone and the bottom of the first housing is pivotally mounted.

In another embodiment, the plate is mounted to the bottom.

In another embodiment, the first housing comprises a single cyclone.

In another embodiment, the at least one cyclone has a volume that is a least 40% of the volume of the first and second housings.

In another embodiment, the at least one cyclone has a volume that is a least 60% of the volume of the first and second housings.

In another embodiment, the vacuum cleaner has dirt separation efficiency of at least 95% of IEC test dirt and at least 50 air watts at the cyclone inlet.

In another embodiment, the second housing includes at least one filter mounted in a filter housing and the housing is removable provided in the second housing and has handles.

In another embodiment, at least one filter is removably mounted in the filter housing.

In accordance with a further alternate aspect, there is provided a strap carriable vacuum cleaner comprising:

(a) at least first and second adjacent housings, each housing having an upper portion, the first housing having a bottom, the first and second housings having a volume; and, (b) the second housing includes at least one filter mounted in a filter housing and the housing is removable provided in the second housing and has handles.

In one embodiment, at least one filter is removably mounted in the filter housing In another embodiment, the vacuum cleaner further comprises at least one openable lid provided on the upper portions, the lid having an inner surface; and an air flow passage from the first housing to the second housing and defined as a volume between the inner surface of the lid and the upper portions of the first and second housings.

In another embodiment, a single lid closes the upper portions.

In another embodiment, the lid is openable.

In another embodiment, the first housing includes a cyclone and the second housing includes a suction motor and fan assembly.

In another embodiment, a plate is provided in the cyclone and the bottom of the first housing is pivotally mounted.

In another embodiment, the plate is mounted to the bottom.

In another embodiment, the first housing comprises a single cyclone.

In another embodiment, the vacuum cleaner has at least one cyclone and the at least one cyclone has a volume that is a least 40% of the volume of the first and second housings.

In another embodiment, the vacuum cleaner has at least one cyclone and the at least one cyclone has a volume that is a least 60% of the volume of the first and second housings.

In another embodiment, the vacuum cleaner has dirt separation efficiency of at least 95% of IEC test dirt and at least 50 air watts at the cyclone inlet.

In another embodiment, the vacuum cleaner has at least one cyclone having a cyclone chamber and a cyclone chamber outlet and air travels from the cyclone chamber to the cyclone chamber outlet without passing through a porous member.

BRIEF DESCRIPTION OF THE DRAWINGS

These and other advantages of the instant invention will be more fully and completely understood in conjunction with the following description of the preferred embodiments of the invention.

DETAILED DESCRIPTION OF THE INVENTION

In accordance with one aspect of this invention, vacuum cleaner 10 comprises a plurality of housings that are adjacent each other. The vacuum cleaner may be a portable vacuum cleaner, e.g., strap carriable as exemplified in FIGS. 1-8 or carriable by a handle as exemplified in FIGS. 15-18 and 24-25, for example a hand vacuum or a wet/dry vacuum cleaner as exemplified in FIGS. 9-14 and 19-22. Preferably, the vacuum cleaner is portable (e.g., hand or strap carriable).

The Figures exemplify how each of the different aspects disclosed herein may be utilized in a single vacuum cleaner. However, it will be appreciated that each aspect may be used without any of the other aspects. It will be appreciated the vacuum cleaner may be altered to utilize a waist strap in lieu of, or in addition to a shoulder strap and/or a handle.

Figure 1:
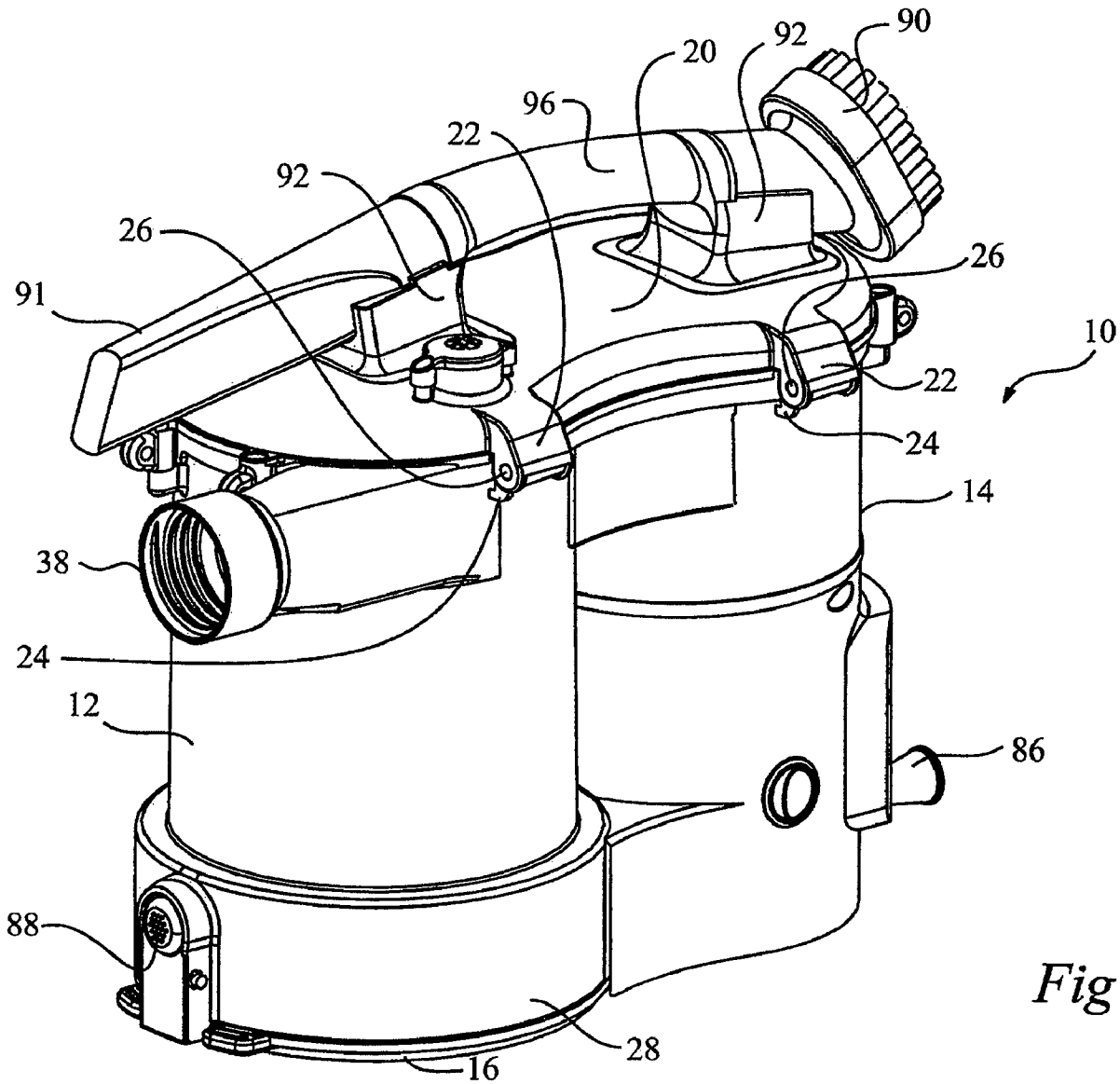
FIG. 1 is a perspective view of a first embodiment of the vacuum cleaner according to the instant invention.

For the purpose of this description, a shoulder strap vacuum cleaner as exemplified in FIG. 1 is initially described. As shown therein two housings are utilized—namely first housing 12 and second housing 14, which are preferably secured together as a single unit. For example, each of first and second housings 12, 14 may be separately manufactured and then secured together, such as by a common base or by gluing, welding or mechanically securing the two housings together.

Figure 2:
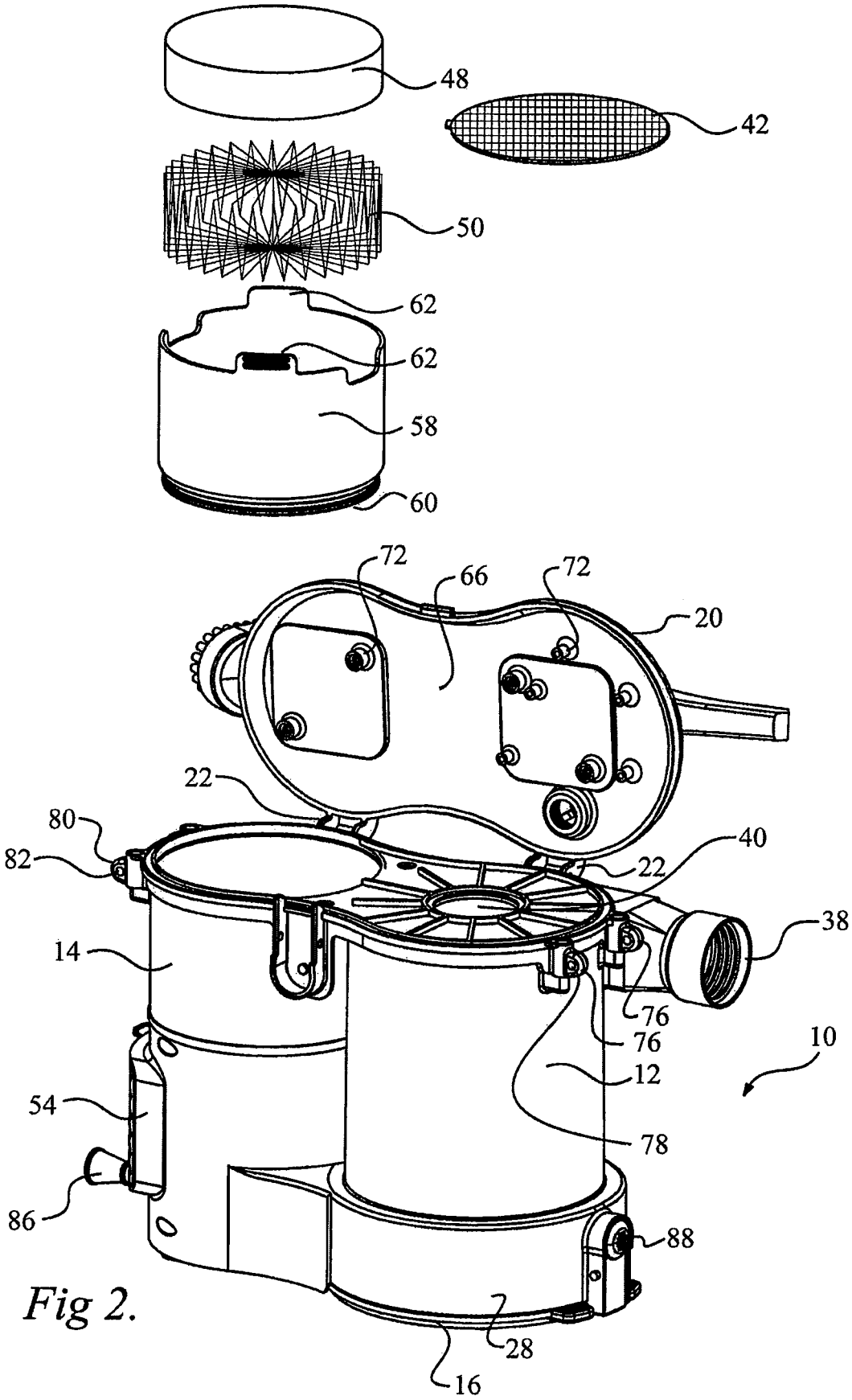
FIG. 2 is a perspective view of the embodiment of FIG. 1 with the lid open and the top accessible screen and filters removed.
Figure 3:
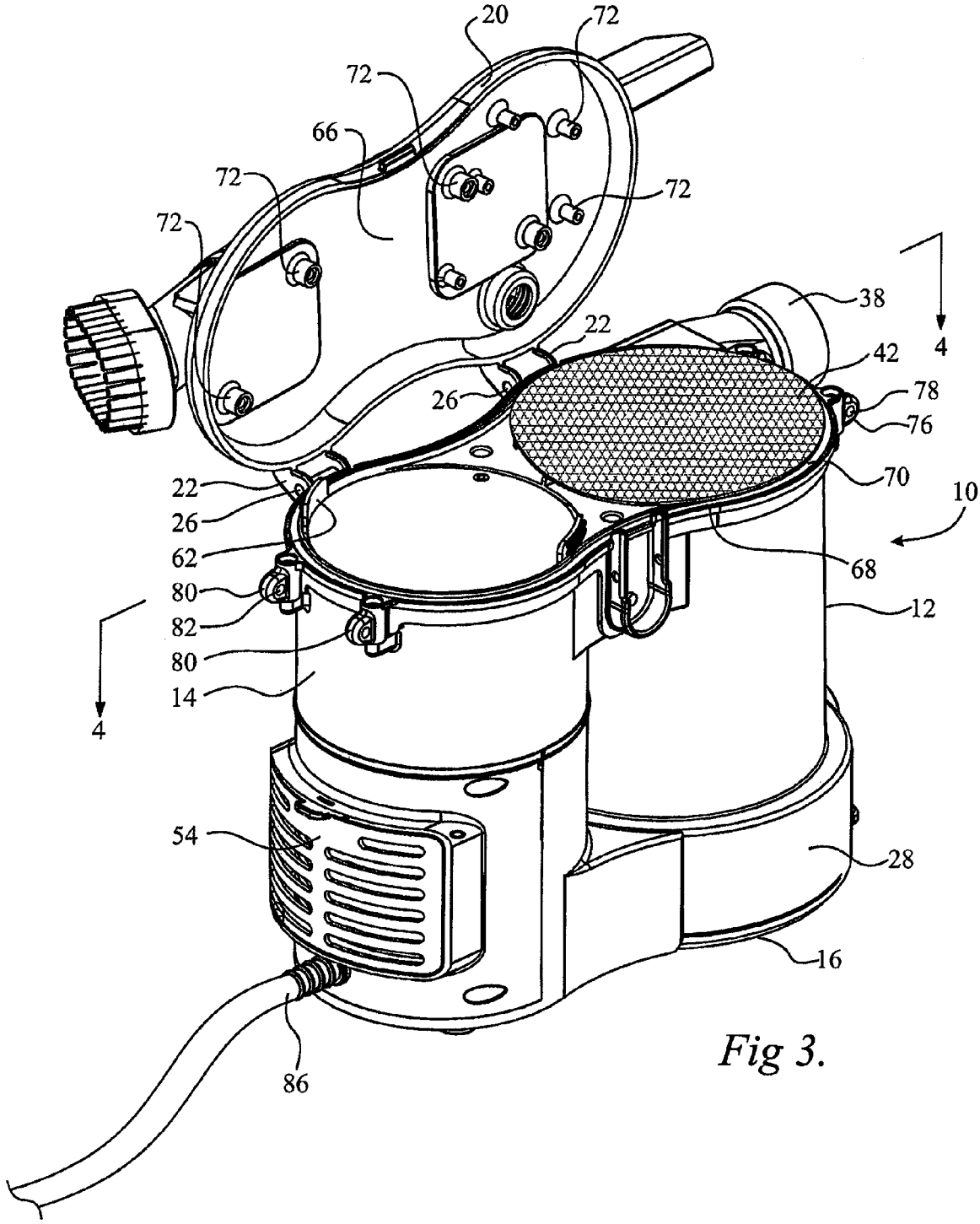
FIG. 3 is a perspective view of the embodiment of FIG. 1 wherein the filters and screen are positioned in the housings of the vacuum cleaner.
Figure 4:
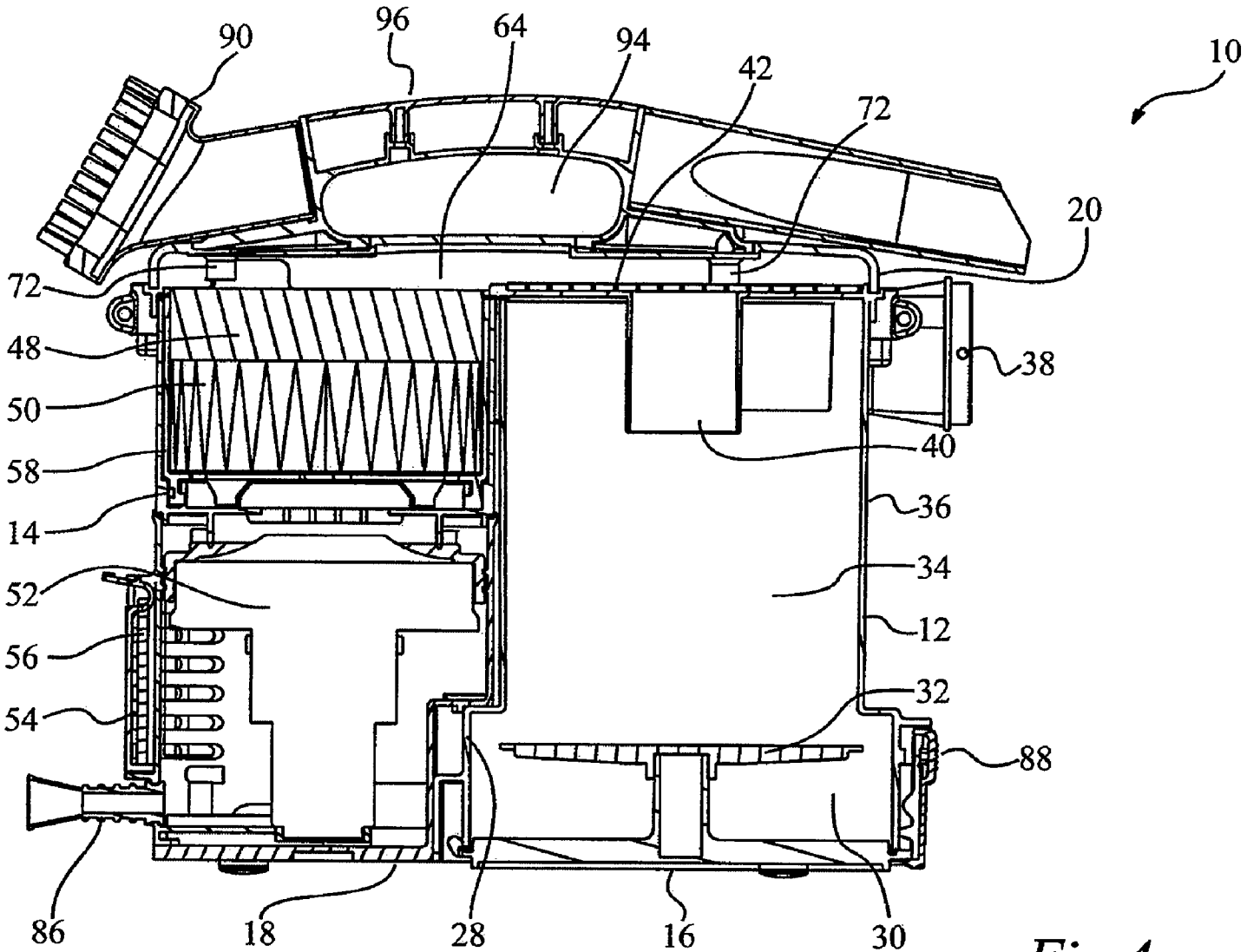
FIG. 4 is a cross-section along line 4-4 in FIG. 3 of a vacuum cleaner when fully assembled.
Figure 5:
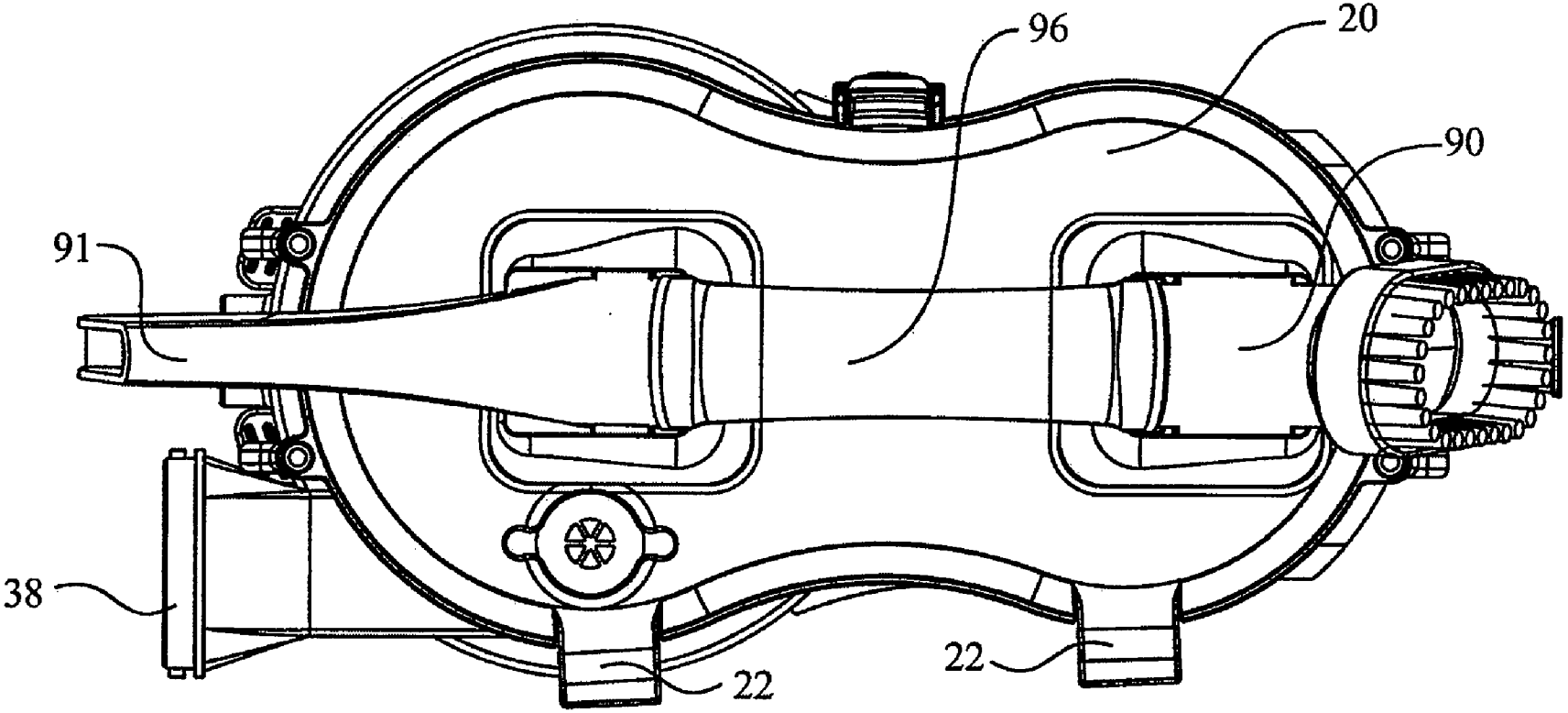
FIG. 5 is a top plan view of the vacuum cleaner of FIG. 1.

As shown in particular in FIG. 4, first housing 12 has a bottom 16, second housing 14 has a bottom 18 and, preferably, each housing has a single combined lid 20. When a user opens lid 20, the user has access to the top of each of housings 12 and 14. In accordance with such an embodiment, as exemplified in FIGS. 1-4, lid 20 may be provided with a plurality of flanges 22, which are mounted on flanges 24, provided on housings 12 and/or 14. Flanges 22, 24 are pivotally connected together by pivot pins 26. Accordingly, lid 20 may be pivoted from the closed position, as shown in FIGS. 1, 4 and 5, to the opening position, as shown in FIGS. 2 and 3. In alternate embodiments, a separate lid may be provided for each of housings 12 and 14. In a further alternate embodiment, whether a single lid or a plurality of lids is provided, it will be appreciated that lid 20 may be removable, i.e., it may merely lift off. It will also be appreciated that lid 20 may be movably mounted by other mean, for example, it may be mounted on a vertical pivot pin so that it rotates in a horizontal plane to permit access to the top of housings 12, 14.

In accordance with this embodiment, or in any alternate embodiment, first housing 12 may comprise a plurality of cyclones and, preferably, only a single cyclone. The cyclone may be of any design known in the art. Preferably, as exemplified in FIG. 4, lower portion of first housing 12 comprises a dirt collection chamber 30 positioned below plate 32. Upper portion 36 of first housing 12 accordingly may comprise a single cyclone chamber 34, which is positioned above plate 32. Air enters first housing 12 via, e.g., air inlet 38. Air inlet 38 may be in airflow communication with a dirty air inlet in a ground engaging head or cleaning tool by, for example, a flexible hose, as is known in the vacuum cleaner art. Air inlet 38 is preferably configured to create a cyclonic flow of air in cyclone chamber 34. Particulate matter, which is separated from the air stream as the air stream travels in a cyclonic pattern in cyclone chamber 34, travels downwardly and is collected beneath plate 32 in dirt collection chamber 30. The air then travels upwardly to exit cyclone chamber 34 via cyclone outlet 40.

Figure 6:
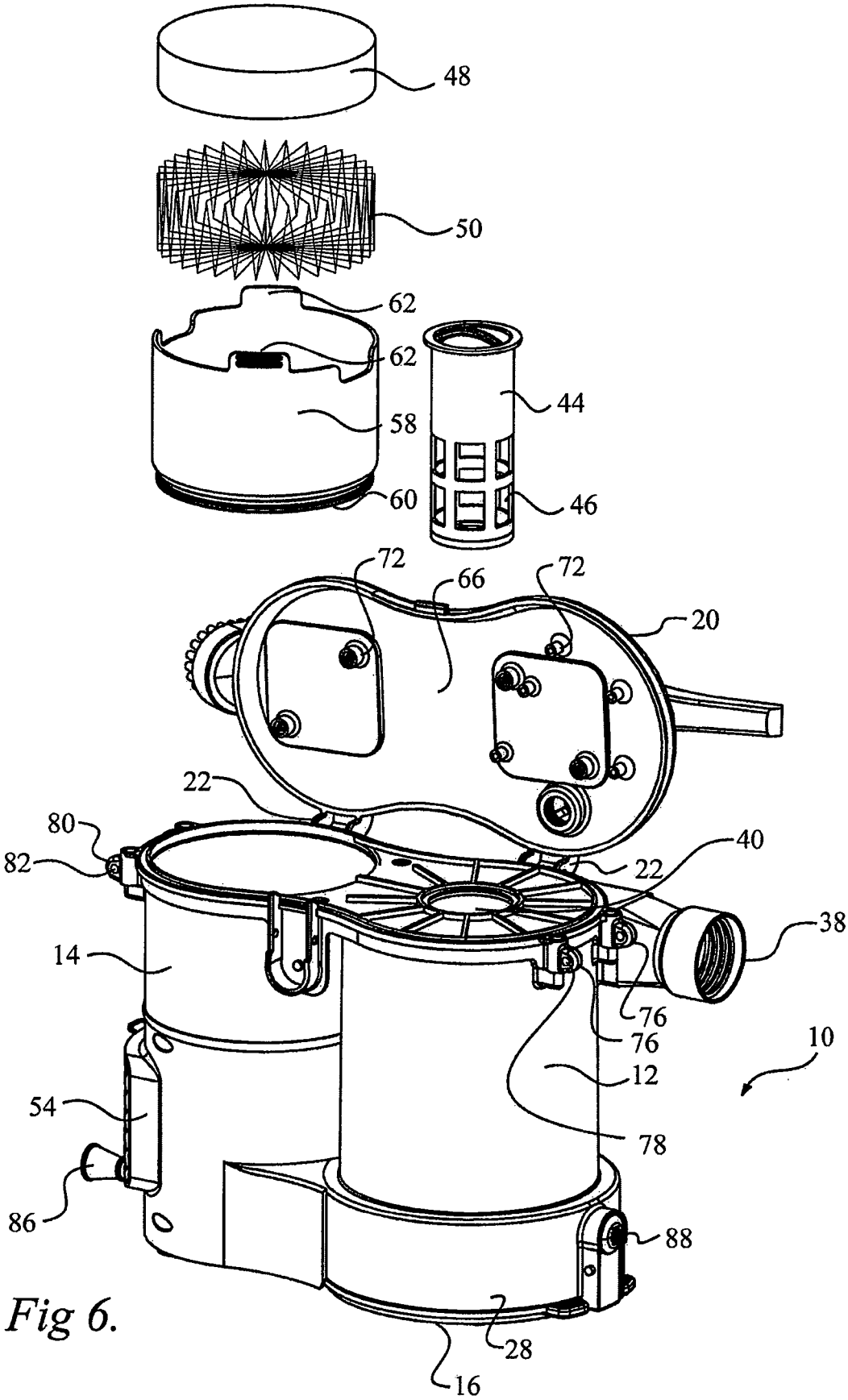
FIG. 6 is a perspective view of a second embodiment of the vacuum cleaner according to the instant invention with the lid open and the top accessible screen and filters removed.
Figure 7:
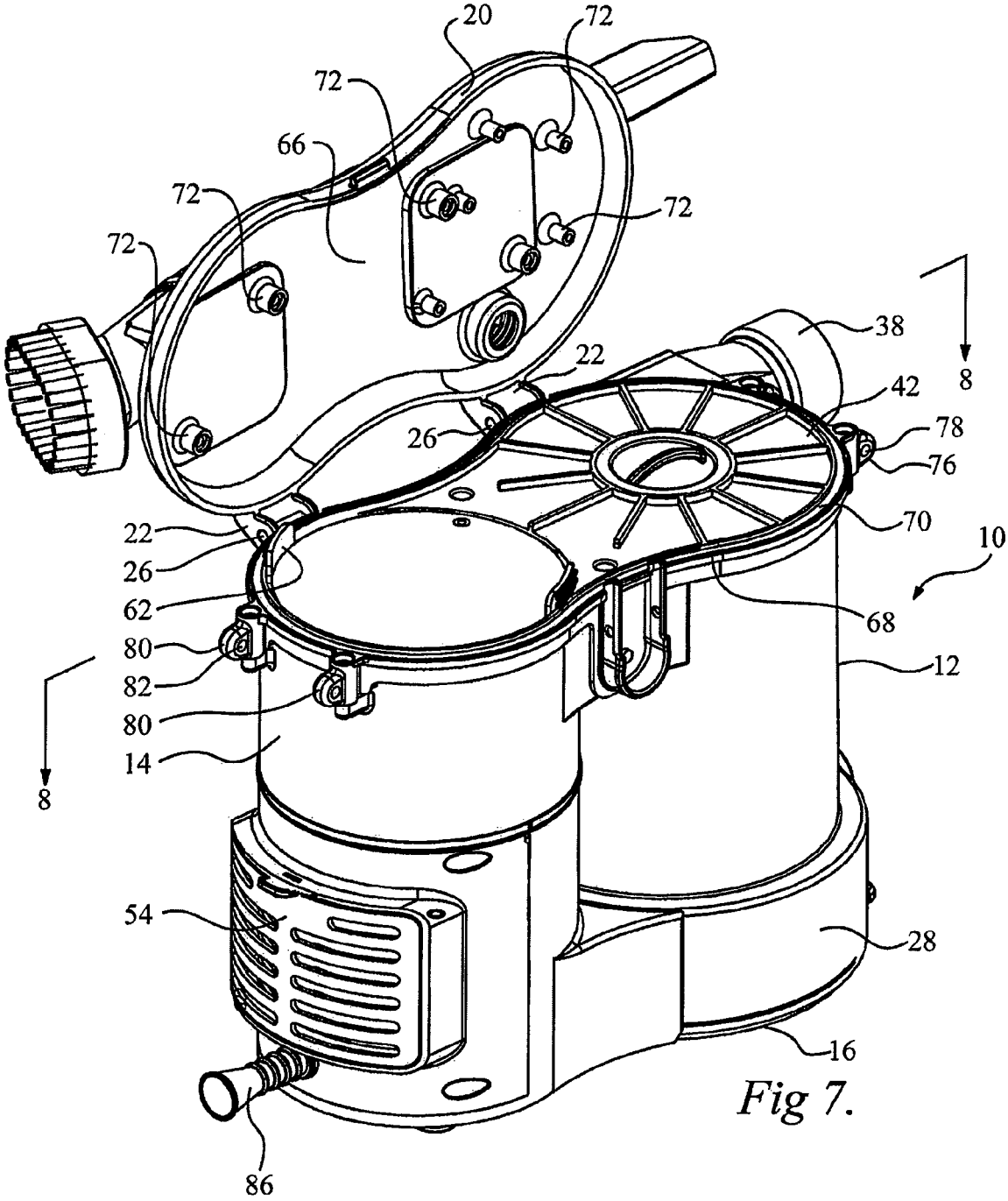
FIG. 7 is a perspective view of the embodiment of FIG. 6 wherein the filters and screen are positioned in the housings of a vacuum cleaner; and, FIG. 8 is a cross-section along line 8-8 in FIG. 7 of the vacuum cleaner when fully assembled.
Figure 8:
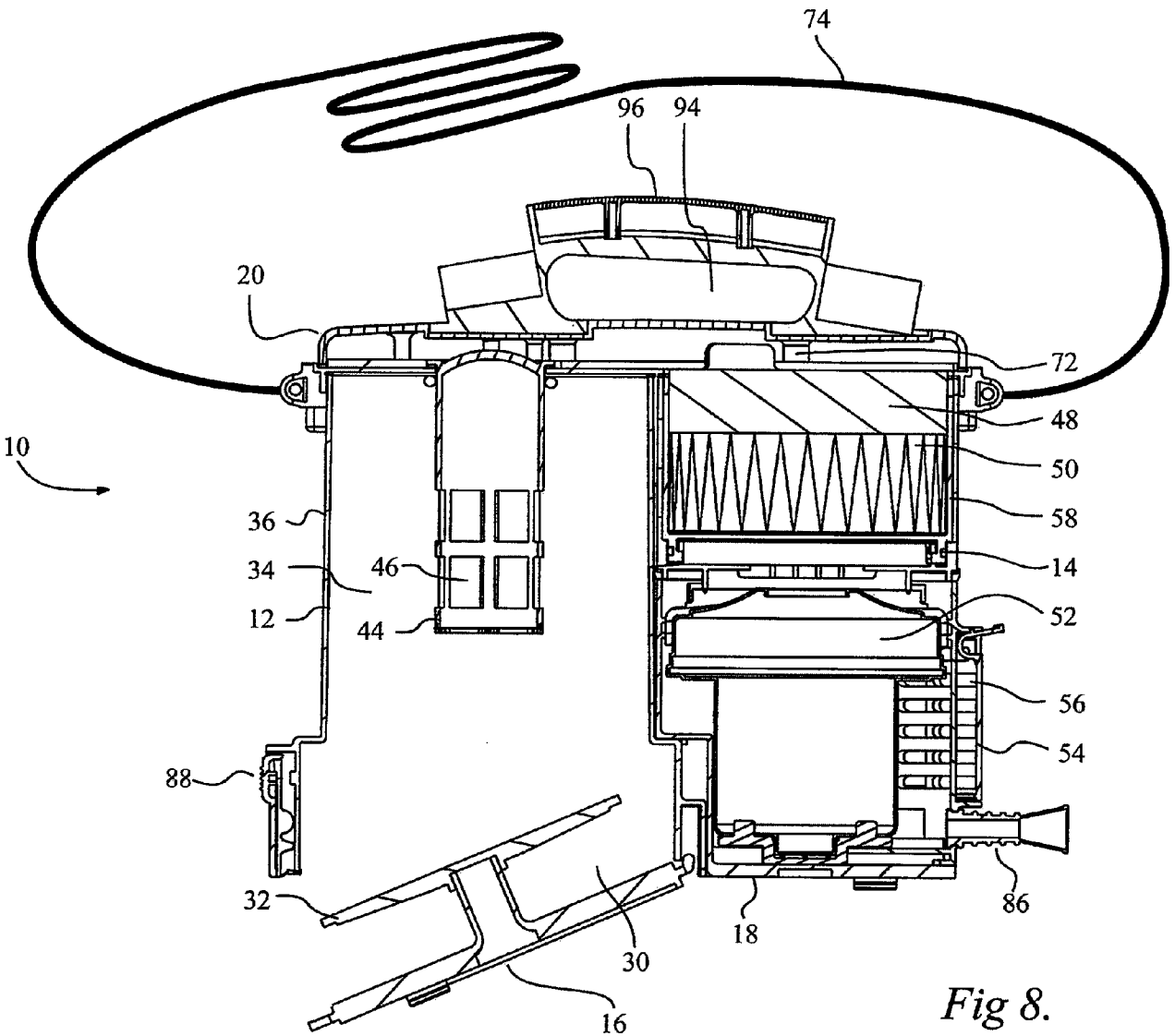
Figure 9:
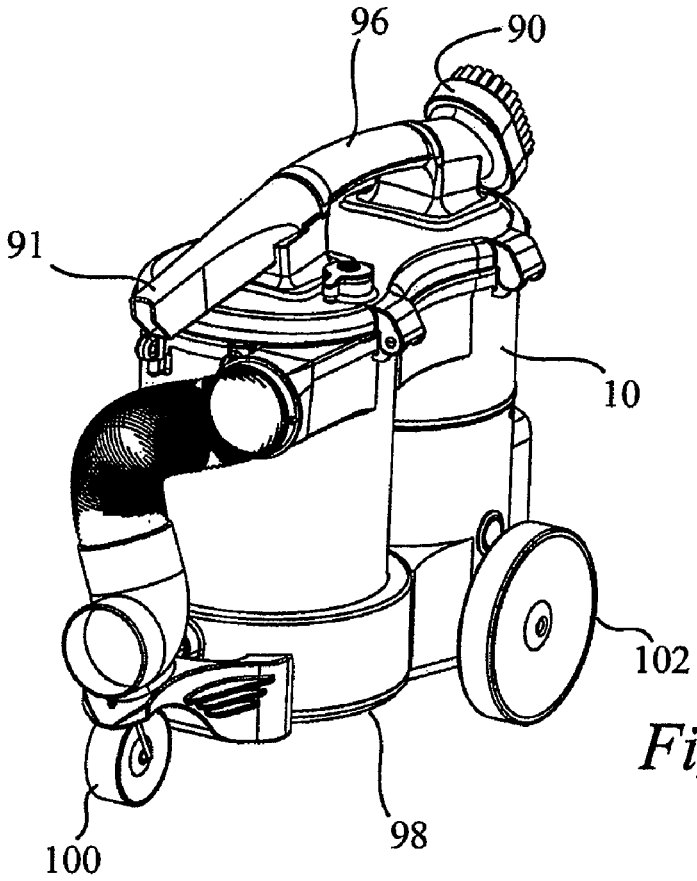
FIG. 9 is a perspective view of a third embodiment of the vacuum cleaner according to the instant invention with vacuum cleaner mounted on a wheeled base.
Figure 10:
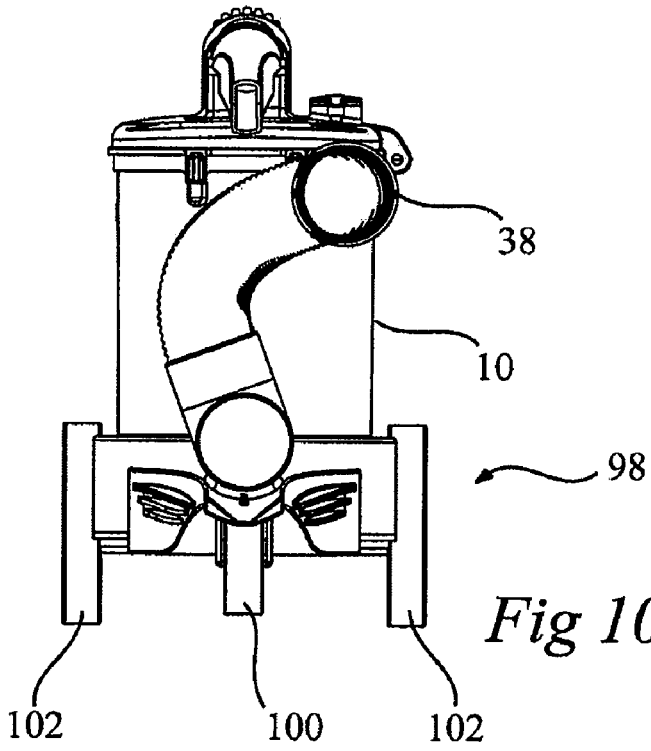
FIG. 10 is a front elevation view of the embodiment of FIG. 9.
Figure 11:
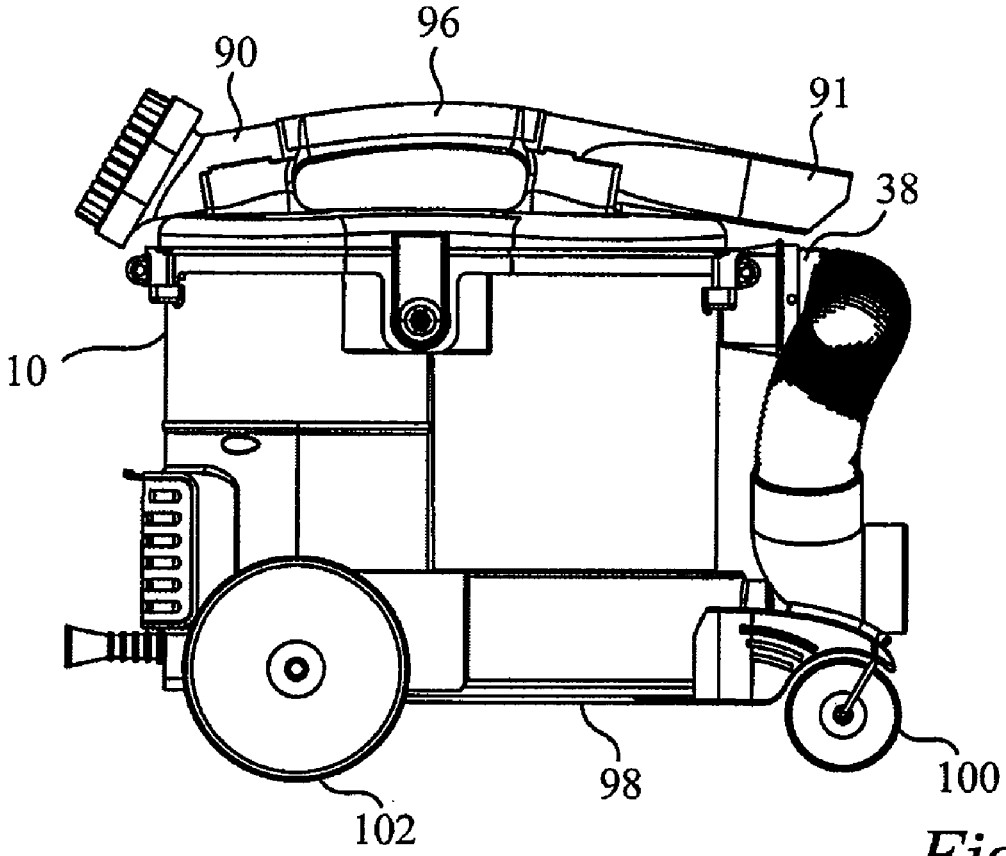
FIG. 11 is a side elevation view of the embodiment of FIG. 9.
Figure 12:
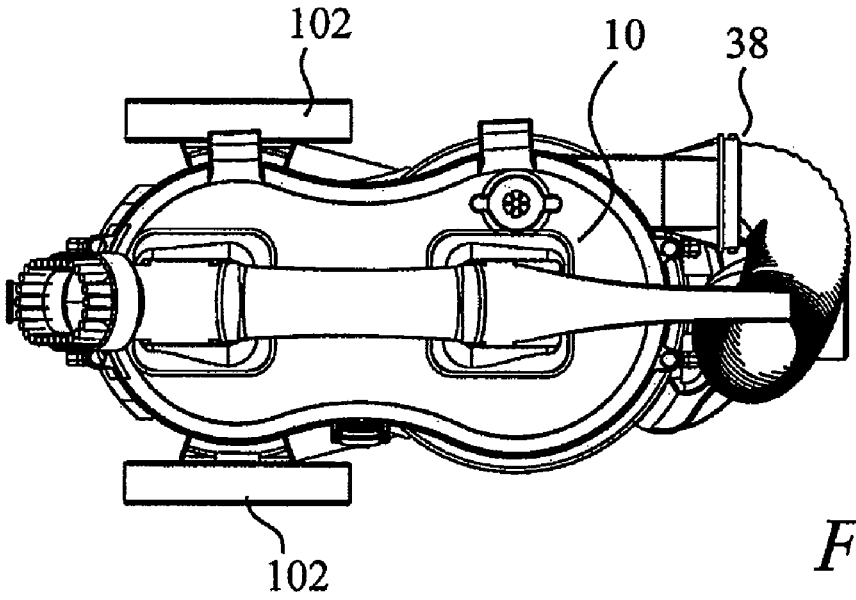
FIG. 12 is a top plan view of the embodiment of FIG. 9.
Figure 13:
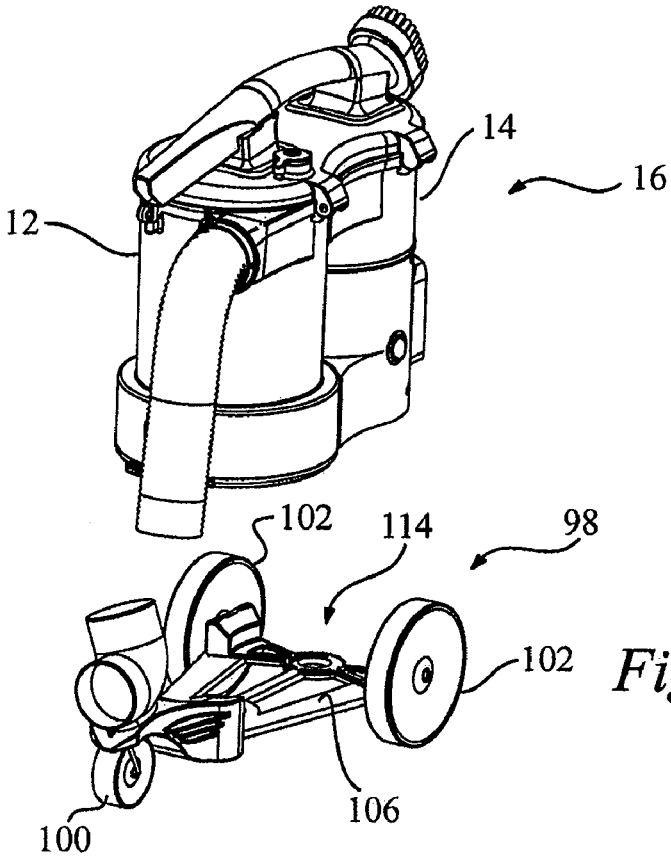
FIG. 13 is an exploded perspective view of the embodiment of FIG. 9 with the vacuum cleaner removed from the wheeled base.
Figure 14:
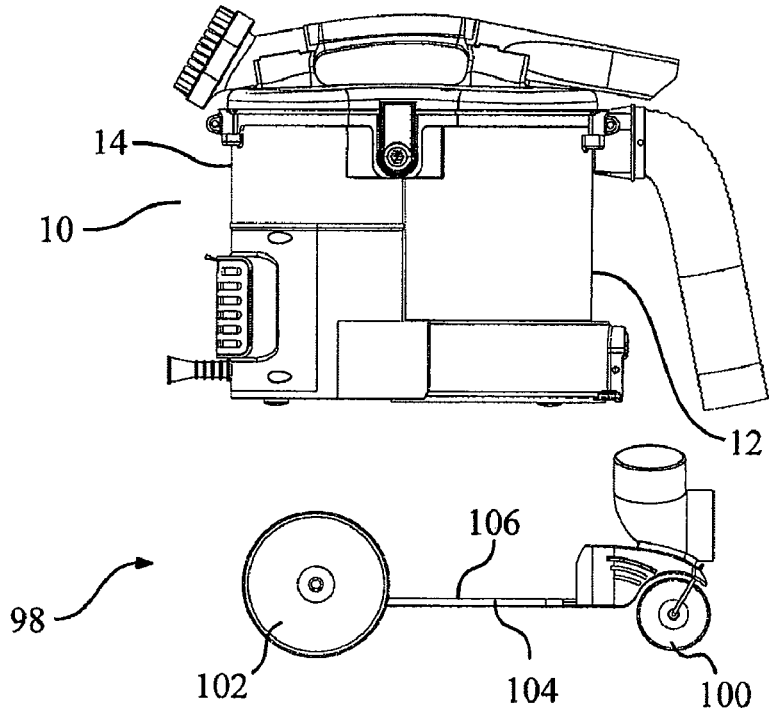
FIG. 14 is a side elevation view of the embodiment of FIG. 9 with the vacuum cleaner removed from the wheeled base.
Figure 15:
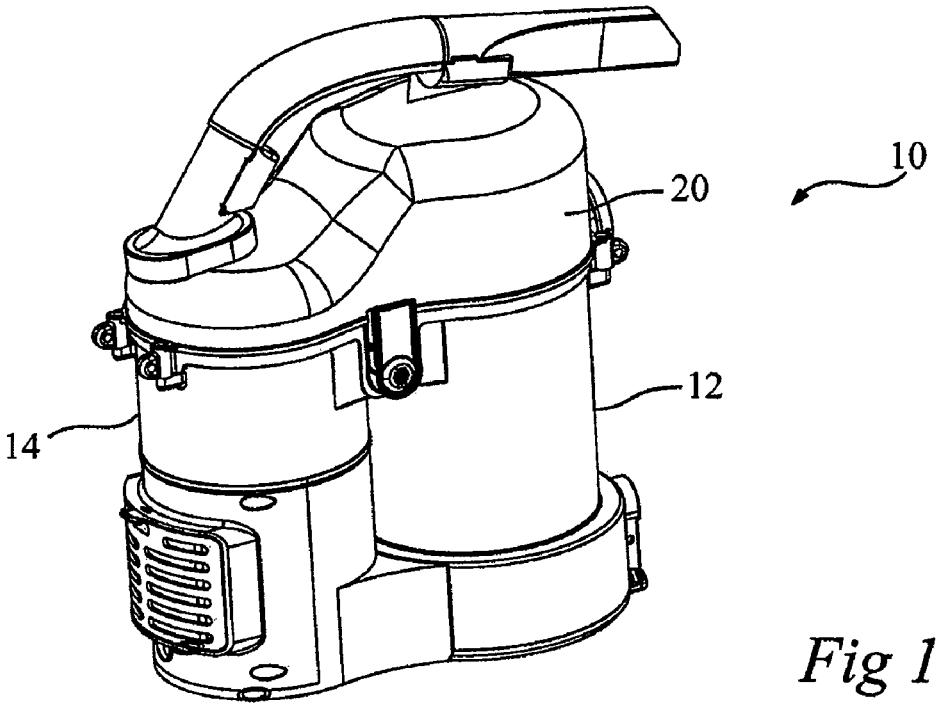
FIG. 15 is a perspective view of a fourth embodiment of the vacuum cleaner according to the instant invention.
Figure 16:
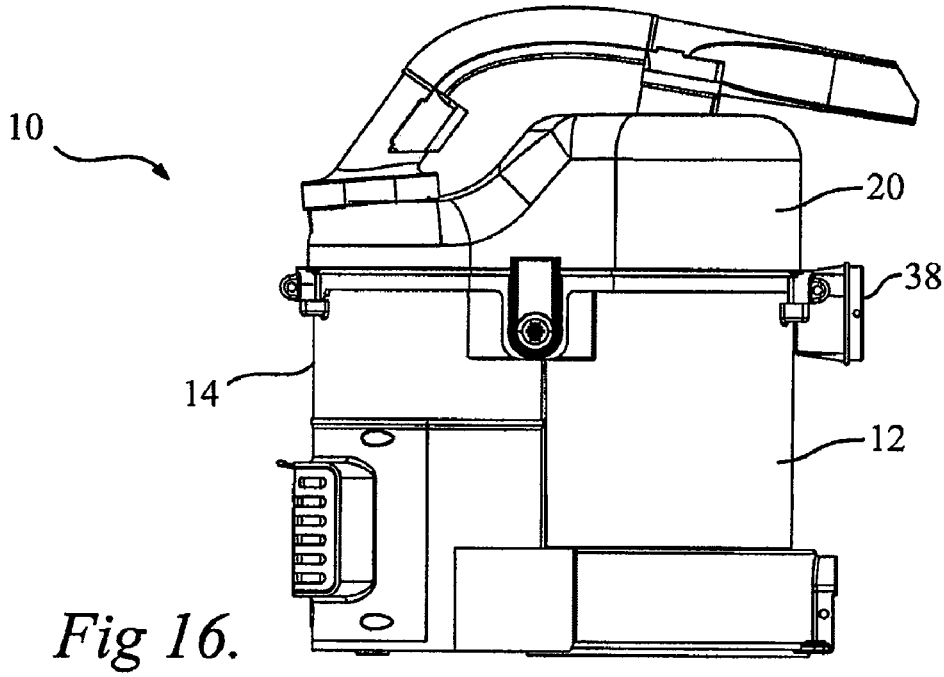
FIG. 16 is a side elevation view of the embodiment of FIG. 15.
Figure 17:
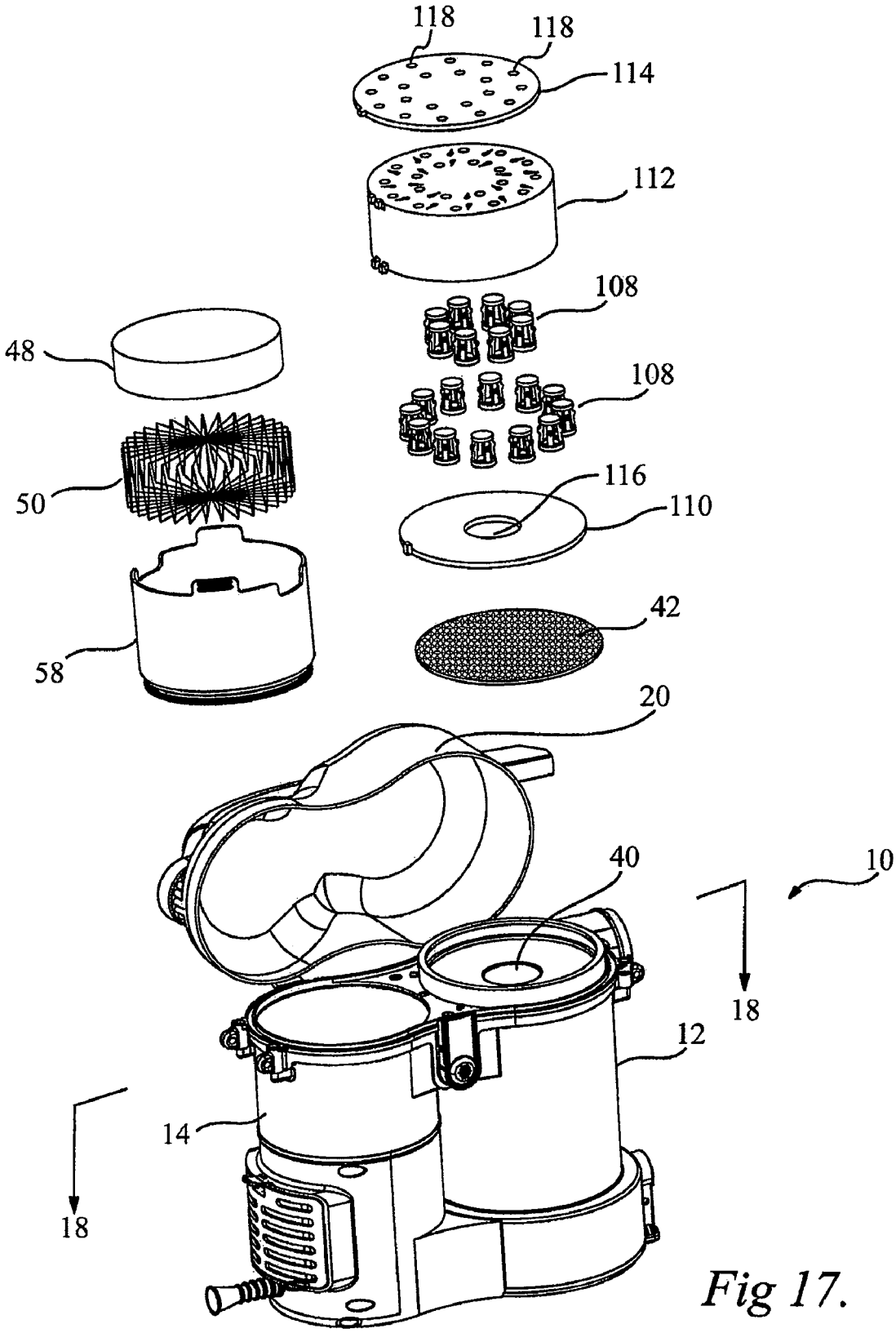
FIG. 17 is a perspective view of the embodiment of FIG. 15 with the lid open and the top accessible screen and filters removed.
Figure 18:
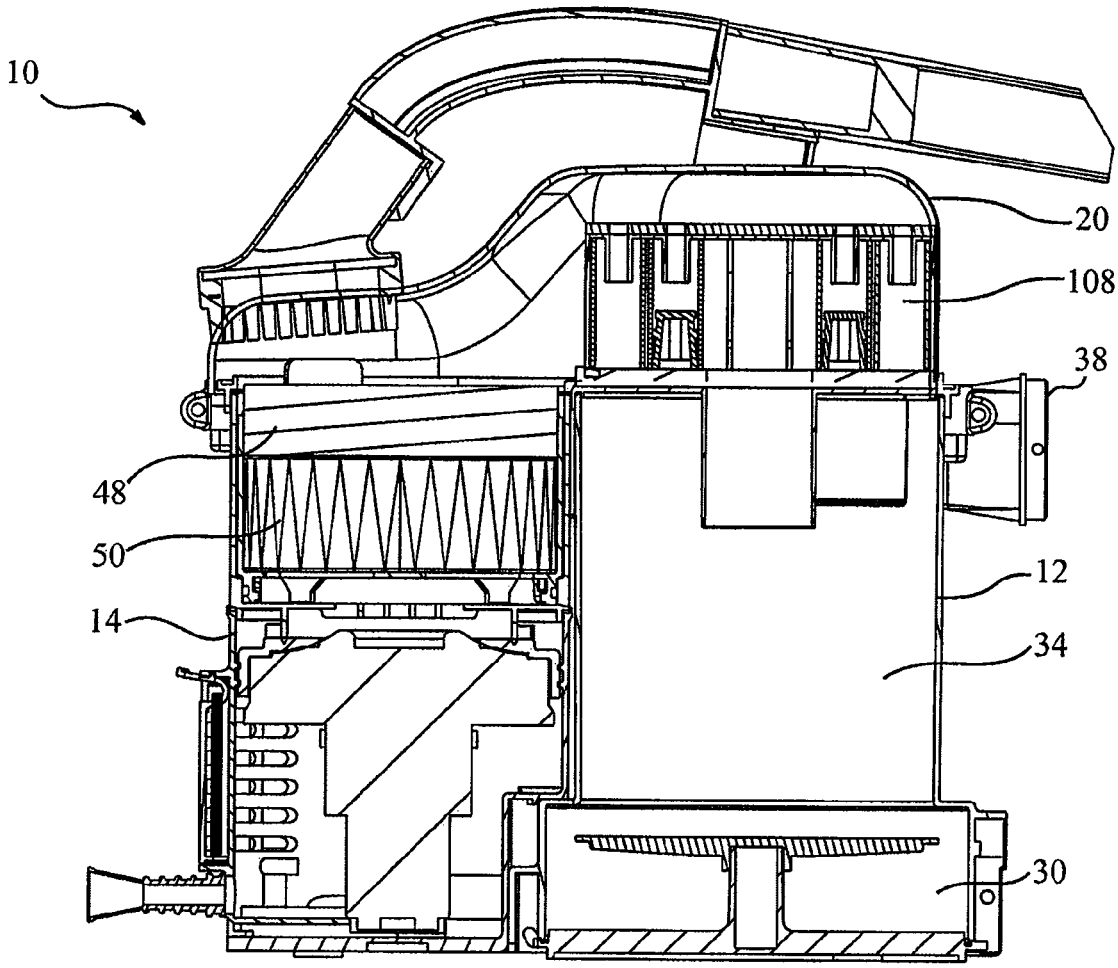
FIG. 18 is a cross-section along line 18-18 in FIG. 17 of the vacuum cleaner when fully assembled.

A filter or a screen may be associated with outlet 40. For example, as shown in FIG. 3, a screen 42 may be positioned on top of cyclone chamber 34 at the exit of cyclone outlet 40. Alternately, as shown in FIGS. 6 and 8, a cylindrical housing 44 may be mounted in cyclone outlet 40 and may have a plurality of openings 46 which may be provided with a screen (e.g. a wire mesh). Cylindrical housing 44 may be slidably mounted in outlet 40 such that when lid 20 is open, as shown in FIG. 7, cylindrical housing 44 may be pulled upwardly for removal and cleaning. Alternately, or in addition, it will be appreciated that a filter may be associated with cyclone outlet 40. If a plurality of first stage cyclones are provided in the first housing, then each may be provided with a filter or screen associated with the outlet 40 of each such cyclone.

As exemplified in FIGS. 2 and 4, a suction motor and fan assembly, as well as one or more optional filters may be provided in second housing 14. As shown therein, the air travels downwardly through second housing 14 through foam filter 48, material filter 50 (e.g. an air filter such as may be utilized for an engine for a car) to the suction motor and fan assembly 52. Subsequent to passing by suction motor and fan assembly 52, the air may exit second housing 14 via one or more openings provided in second housing 14 (e.g. grill 54). If a post motor filter is desired, then grill 54 may be openable or removable to reveal a filter 56, which may be positioned between second housing 14 and grill 54. Preferably, filter 56 is removable for cleaning or replacement.

It will be appreciated that no filters may be provided in second housing 14 upstream of suction motor and fan assembly 52. Alternately, only one filter, or more than two filters, may be provided.

In accordance with an alternate aspect, a removable filter housing may be provided. The removable filter housing may be used by itself in a vacuum cleaner or in combination with any other embodiment of a vacuum cleaner as set out herein. For example, it may be used with a strap carriable vacuum cleaner with side-by-side housings containing a cyclone and a suction motor or a strap carriable vacuum cleaner that uses side-by-side housings and a common lid, regardless of whether a suction motor is provided in one of the side-by-side housings.

As exemplified in the preferred embodiment of FIG. 2, filters 48 and 50 are removably mounted in removable filter housing 58. Filter housing 58 may be mounted in second housing 14 by any means known in the art. For example, it may be mounted therein by a thread 60, which is receivable in a mating thread provided in second housing 14. Alternately, a bayonet mount, a friction fit or a tie down bolt may be used. Accordingly, filter housing 58 (with filters 48, 50) provided therein, may be unscrewed from second housing 60 and removed to permit the filters to be cleaned or replaced. One advantage of this design is that a user need not directly touch filters 48, 50 to remove the filters from the vacuum cleaner. The user may merely grasp handles 62 to remove (e.g., unscrew) filter-housing 58 and transport it to a location where the filters may be washed or thrown out. It will be appreciated that this filter housing may be used in any vacuum cleaner.

An air conduit connects outlet 40 of cyclone chamber 34 with the top of second housing 14. Preferably, in accordance with another aspect, the airflow connection is provided by plenum 64, which is defined by the open space between inner surface 66 of lid 20, and the top of first and second housings 12, 14. This aspect may be used with any side-by-side embodiment, regardless of the dirt separation technology used in the first housing 12 and regardless of whether a suction motor is provided in housing 14.

In order to prevent air leaking into plenum 64 from exterior to the vacuum cleaner, a deformable seal, such as resilient bead 68 may be provided. For example, a shown in FIG. 3, each of first and second housings 12, 14 have a continuous top surface 70 on which resilient bead 68 is provided. When lid 20 is closed and locked into position, if the lock compresses bead 68, then an air tight seal will be provided such that air will not leak into plenum 64. Resilient bead 68 may be made out of any compressible material known in the vacuum cleaner art. For example resilient bead 68 may be manufactured from material that is similar to material used to manufacture O-rings. The lock may be a lever or any other device that will draw the lid down on the housings 12, 14 as the lock is moved into the locked position.

In order to secure filter 48 and screen 42 in position, inner surface 66 may be provided with a plurality of stand offs 72 which have a sufficient length such that, when lid 20 is locked closed, the bottom of stand offs 72 engage the top of screen 42 and/or foam filter 48 thereby securing them in position.

Shoulder strap 74 (shown in FIG. 8) may be secured to vacuum cleaner 10 by any attachment means known in, for example, the handbag or backpack arts. As shown in FIGS. 2 and 3, first housing 12 is provided with a pair of flanges 76, each of which has an opening 78. Similarly, second housing 14 is provided with a plurality of flanges 80, each of which has an opening 82. A pin (not shown) may be provided to extend through the pair of openings 78, and another pin may extend through the pair of opening 82 so as to provide a shaft around which strap 74 may be secured.

Strap 74 may be alternately mounted on a reel, which may be lockable in a plurality of pre-set positions or infinite positions, so as to permit a fixed amount of shoulder strap 74 or waist strap to be deployed. The reel for shoulder strap 74 or waist strap may be a self-winding reel, as are used for an electrical cord, such as is known in the household appliance art. The strap, when not in use, may be wound on to the reel by the reel being biased to draw the strap onto the reel (or by the strap being manually wound on the reel). When the vacuum cleaner is to be used, a user may pull or unwind a sufficient amount of the strap out of the reel until the vacuum cleaner is at an appropriate height when worn, such as over the shoulder of a user. The reel may then be locked in place such that the length of the strap is fixed.

An electrical cord may be connected to vacuum cleaner 10 at any appropriate location. As exemplified, an electrical cord (not shown) passes through optional cord mount 86, which may be positioned at the bottom of second housing 14 adjacent suction fan and motor assembly 52.

One advantage of having a single cyclone in first housing 12 is that all of the dirt collected by the cyclonic action in cyclone chamber 34 will collect in dirt collection chamber 32. Accordingly, dirt collection chamber 30 may be emptied by opening bottom 16. As exemplified in FIG. 8, bottom 16 may be hinged to second housing 14 such that bottom 16, and, preferably plate 32, both pivot to a generally vertical position so as to permit dirt to fall out of chamber 30 into, e.g., a trash receptacle. Bottom 16 may then be secured in the closed position shown in FIG. 2 by any means known in the art. For example, as shown in FIG. 4, a push button 88 may be provided for releasing a catch to permit bottom 16 to pivot open.

In accordance with a further aspect, one or more accessories, such as cleaning brush 90 and wand extension 91 may be secured to the upper surface of lid 20, such as by means of mounts 92. As exemplified, central section 96 is configured to function as a handle (e.g. central section 96 may be arcuate in shape or be spaced from lid 20), to define an opening 94 between central section 96 and the upper surface of lid 20 such that central section 96 of brush 90 may be a carry handle for the vacuum cleaner.

It will be appreciated that any of the optional embodiments described herein may be used singularly in a vacuum cleaner or may be combined with one or more of the other preferred features to create a series of different vacuum cleaners, each of which is the subject of this disclosure.

In accordance with an alternate embodiment as exemplified in FIGS. 9-14, vacuum cleaner 10 is shown mounted on wheeled base 98. As exemplified therein, vacuum cleaner 10 is preferably removably mounted to wheeled base 98, such as by means of a bolt, a quick release latch, a friction mount or any other means known in the art.

Base preferably has a plurality of wheels that are arrayed so as to provide a stable platform. As exemplified, wheeled base 98 has a single front wheel, 100 and a pair of rear wheels 102. Front wheel 100 is preferably rotatably mounted (e.g., a caster wheel). Rear wheels 102 preferably have a larger diameter then front wheel 100 and may be non-rotatably mounted on an axle. Wheeled base defines a frame 104 having a surface 106 on which vacuum cleaner seats.

In an alternate embodiment, it will be appreciated that the wheels may be mounted to vacuum cleaner 10 and may be permanently mounted thereto.

A further alternate embodiment is exemplified in FIGS. 15-18. According to this alternate embodiment, vacuum cleaner 10 has a first housing 12 that includes a second cyclonic stage. First housing 12 may incorporate two or more cyclonic stages, and optionally one or more filters, wherein each cyclonic stage comprises a single cyclone, or a plurality of cyclones in parallel. Alternately, the second cyclonic stage may be provided in second housing 14.

As exemplified in FIGS. 15-18, a plurality of smaller second stage cyclones 108 may be provided in a housing. For example, the housing may be constructed from a lower base plate 110 and an upper housing 112 and top plate 114. Air may enter the second cyclonic stage via one or more openings 116, which are positioned to be in air flow communication with outlet 40 from the first cyclonic stage (e.g., a single inlet 116 that is positioned above outlet 40). The air may then be distributed to the inlets of the second stage cyclone by any means known in the art (e.g. a header or merely an open volume that communicates with outlet 40 and the inlets of the second stage cyclone). The air exits the second stage cyclones via second cyclonic stage outlets. The treated air is then directed to second housing 14.

In order to accommodate the second cyclonic stage, the height of the first cyclonic stage may be reduced and/or the height of lid 20, at least above first housing 12, may be increased. The second stage may be removably mounted in first housing 12 (e.g., the housing defined by lower base plate 110 and upper housing 112 may be removable and may optionally be provided with a handle (not shown) on the top thereof to enable a user to lift the second cyclonic stage upwardly out of housing 12). Accordingly, the second stage may be removed for emptying or optionally replacement when it is full. Alternately, the second cyclonic stage may be emptyable with the first cyclonic stage, as is known in the vacuum cleaner art.

Preferably, housings 12, 14 are about the same height. However, it will be appreciated that the heights of housings 12, 14 may vary. Preferably, the ratio of the height of housings 12 to the height of housing 14 is from 1:0.6 to 0.6:1; more preferably from 1:0.75 to 0.75:1 and most preferably from 1:0.9 to 0.9:1.

Figure 24:
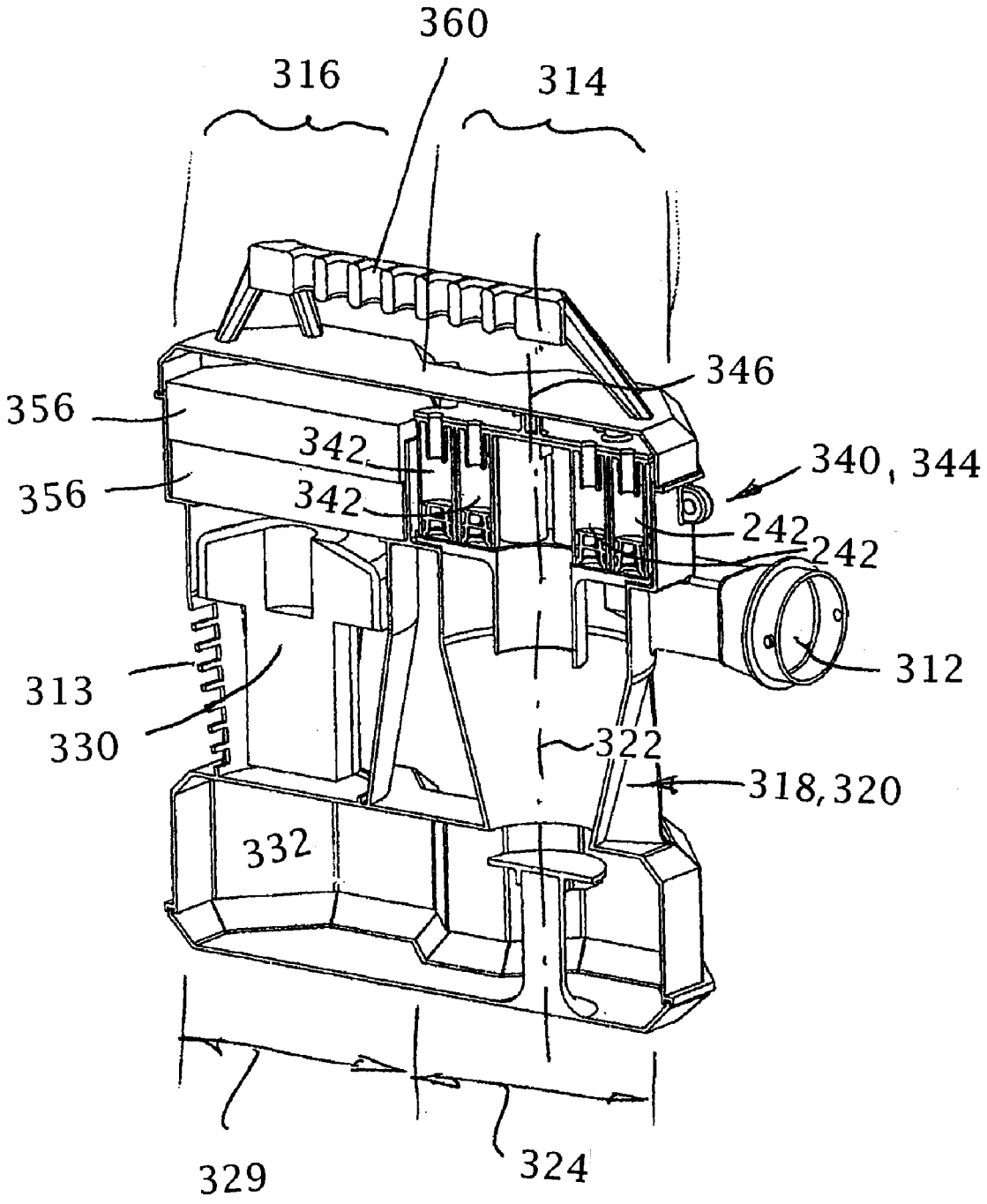
FIG. 24 is a section view of the apparatus of FIG. 23 taken along the line 24-24.

It will be appreciated that each hosing extends linearly. As shown in FIGS. 2 and 24, housings 12, 14, each comprise a cylinder having a longitudinally extending axis. Preferably, these axis are parallel. Therefore, if housings 12, 14 have a constant diameter, then housings 12, 14 will have a constant spacing therebetween, or the may be touching. It will be appreciated that each axis may be at an angle of up to 10 degrees from the vertical. Therefore the axis will intersect at some point and the angle of intersection is preferably less than 20 degrees and more preferably less than 10 degrees. As exemplified in FIGS. 4 and 24, the motor, which includes a suction fan, is preferably aligned with the axis of the housing. As exemplified, the fan section of the suction motor 52 (which is exemplified as having a larger diameter) is positioned above (upstream of) the windings (motor section) of the suction motor and fan assembly. Accordingly, as exemplified, the air traveling through housing 14 is traveling parallel to the axis of the housing 14 and the axis of suction motor 52.

It will be appreciated that housings 14 and 14 may be separately manufactures and then secured together. For example, the upper and lower ends of each housing 12, 14 may be secured to and upper and a lower housings. Alternately, or in addition, the portions of sidewalls of housings 12, 14 may be secured together, such as by mechanical means (e.g., screws), welding or an adhesive. Alternately, or in addition, housings 12, 14 may be integrally molded. Preferably, housing 12 is transparent to permit a user to see the cyclonic flow in the first stage cyclone. Therefore, if housings 12, 14 are integrally molded, both housings 12, 14 are preferably transparent.

In accordance with another aspect, a canister or wet/dry vacuum cleaner is provided wherein a cyclone casing and a motor housing are attached, and preferably removably attached, to the top of a dirt bin for the vacuum cleaner and/or a mounting spine of the vacuum cleaner. Preferably they are separately attached, and more preferably at least one is removably attached, thereto.

Figure 19:
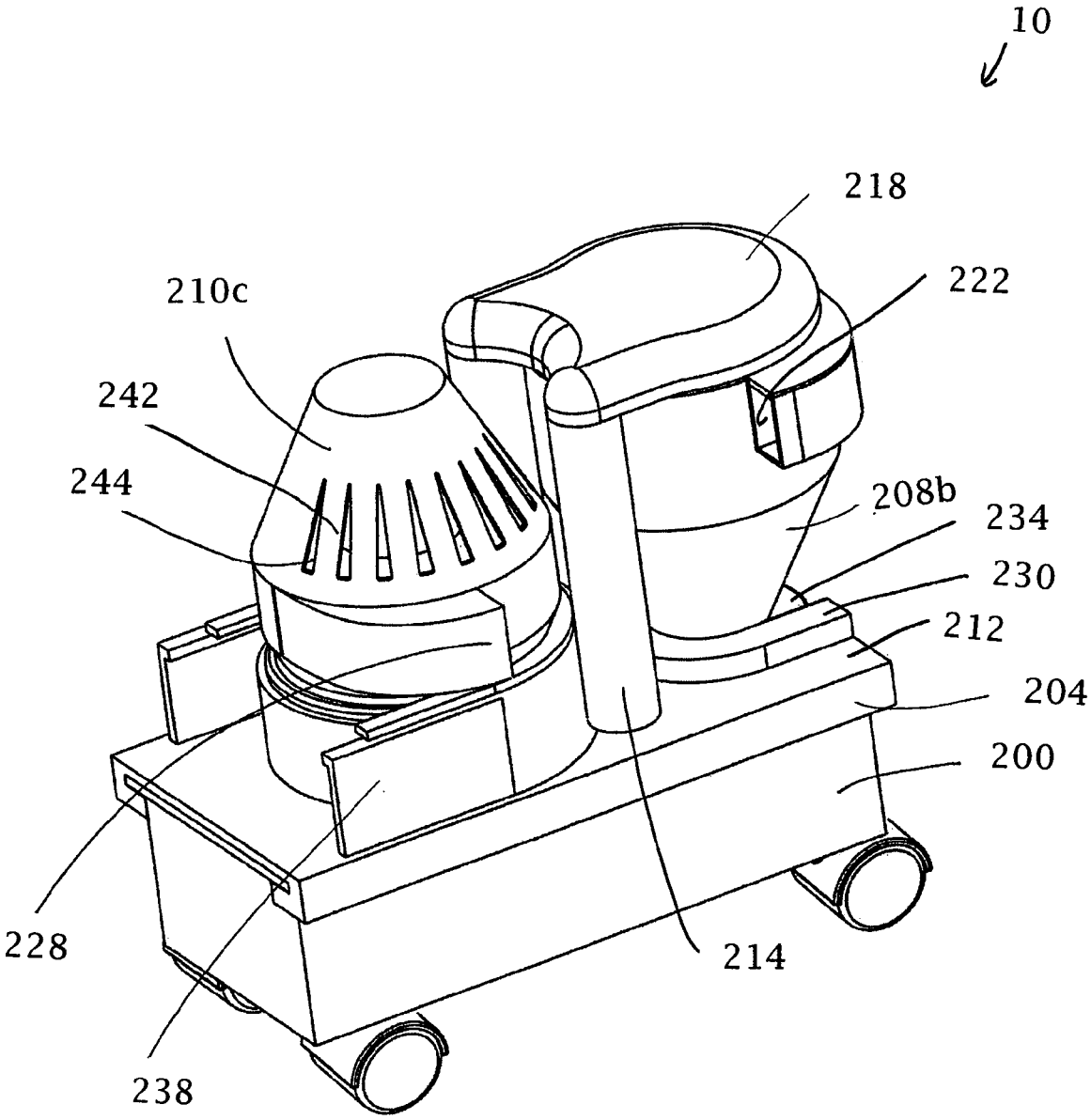
FIG. 19 is a perspective view of a canister or wet/dry vacuum cleaner according to a fifth embodiment of the instant invention.
Figure 20:
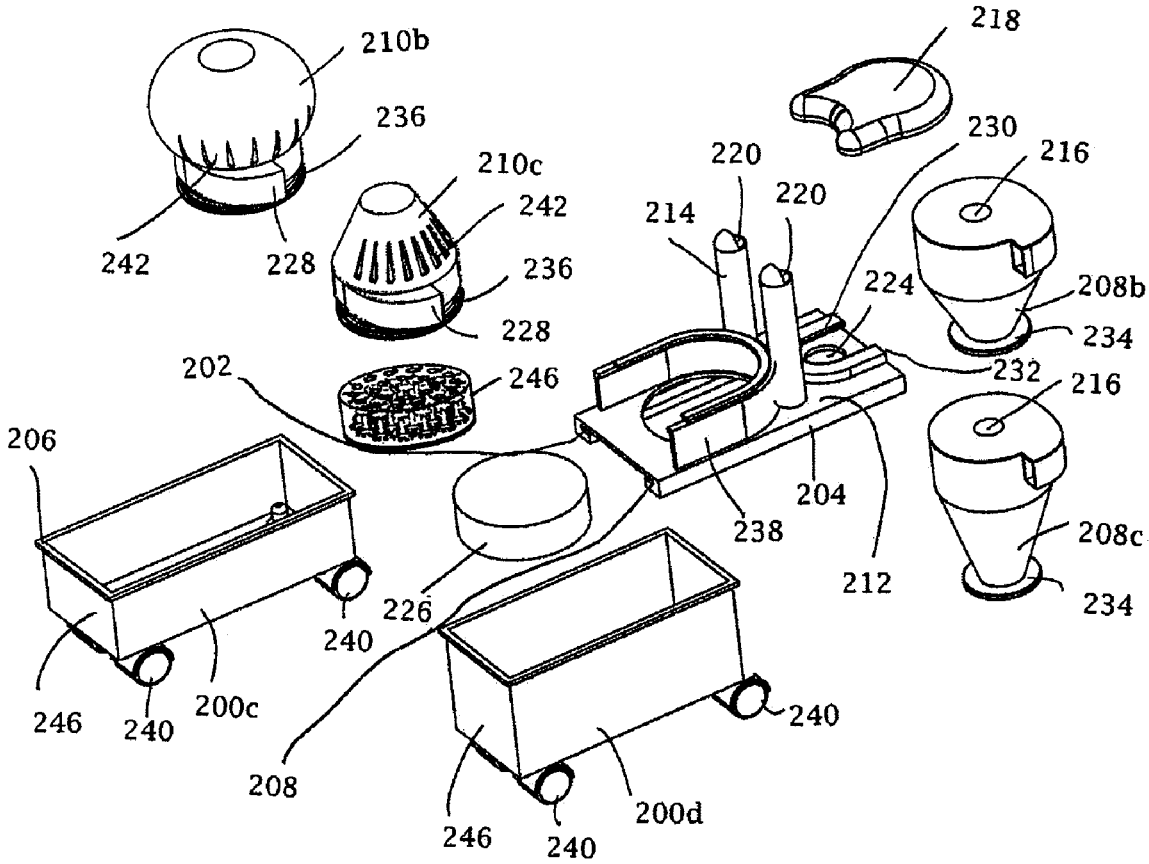
FIG. 20 is an exploded view showing a plurality of components which may be utilized to construct a canister or a wet/dry vacuum cleaner according to the alternate embodiment exemplified in FIG. 19.
Figure 21:
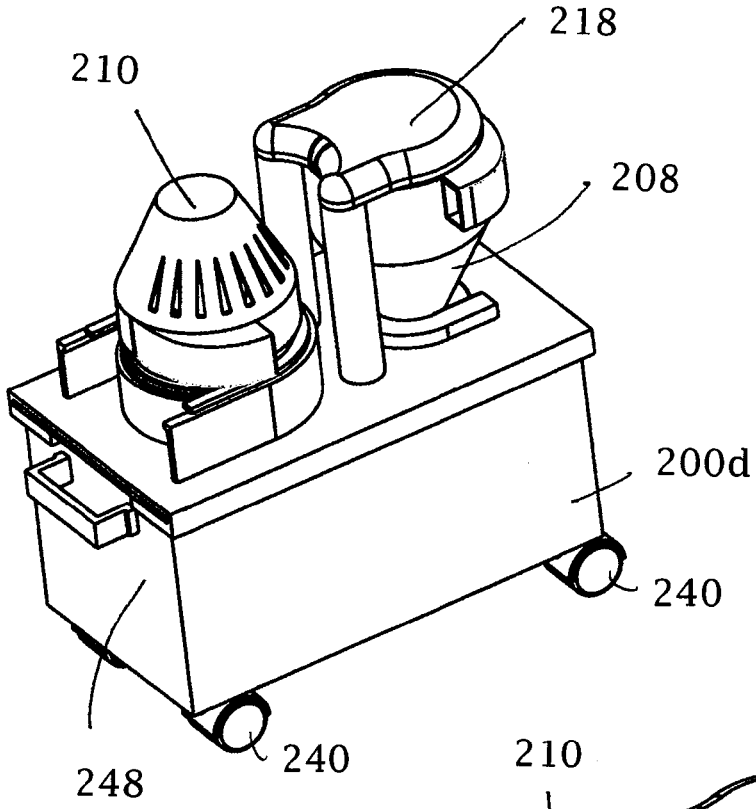
FIG. 21 is a perspective view of an alternate embodiment of the canister or wet/dry vacuum cleaner of FIG. 19 wherein a side door is provided on the dirt bin.
Figure 22:
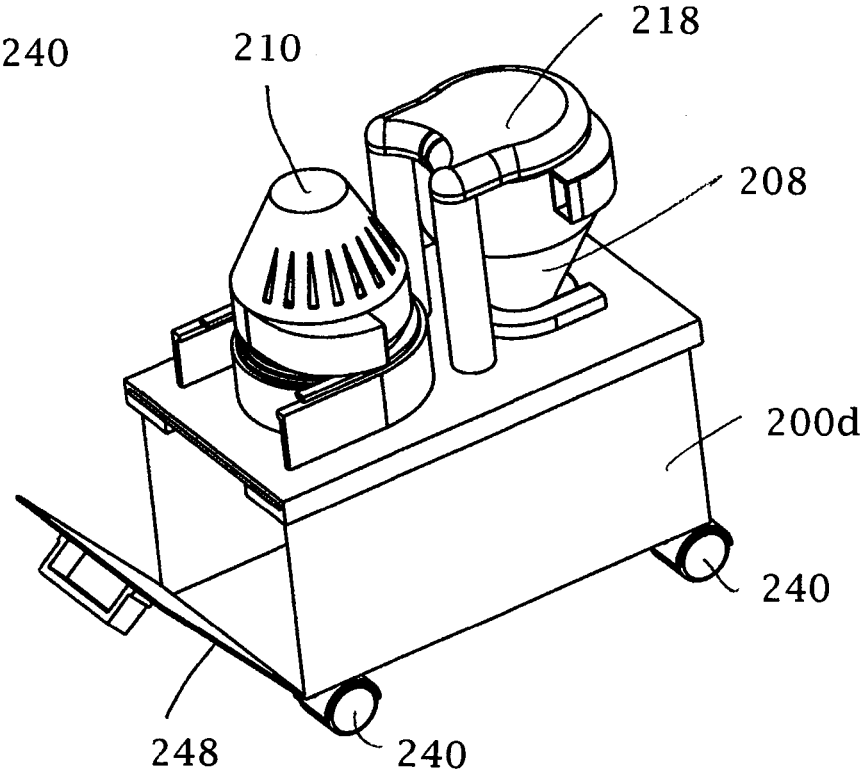
FIG. 22 is a perspective view of the vacuum cleaner of FIG. 21 wherein the door is open.

As exemplified in FIGS. 19 and 20, vacuum cleaner 10 comprises a dirt bin 200, which is preferably slidably received in slots 202 of spine plate 204. A deformable seal or the like may be provided on rim 206 to provide an air tight seal when vacuum cleaner 10 is in use. A cyclone casing or housing 208 and a motor casing or housing 210 are attached, and preferably separately attached, and, most preferably removably separately attached to spine plate 204.

As shown in FIG. 20, spine plate 204 has a top surface 212 with down flow ducts 214. Cyclone casing 208 is provided with a cyclone outlet 216. Lid 218 is mounted on cyclone casing 208 and connects cyclone outlet 216 with the inlet 220 to down flow ducts 214. Motor casing 210 is provided with an outlet. In operation, a flexible hose may be secured to cyclone inlet 222. The air will travel through cyclone casing 208 and the air will exit the cyclone chamber via outlet 216 and dirt will exit the cyclone chamber and enter dirt bin 200 via inlet 224. The passage underneath lid 218 connects cyclone outlet 216 with inlets 220. The air will travel downwardly through down flow ducts 214 to a passage that connects with the inlet to motor housing 210. The air may travel through one or more filters in filter housing 226, prior to traveling to the suction motor and to outlet 228.

It will be appreciated that only one down flow duct 214 may be provided. In addition, a passage may be provided which extends inlet 216 to an alternate position on vacuum cleaner 10.

Cyclone casing 208 is preferably removably mountable on top surface 212 by any means known in the art. For example, as exemplified in FIG. 20, top surface 212 is provided with a U shaped flange 230 so as to define a slot 232 that extends between U shaped flange 230 and top surface 212. Cyclone casing 208 is provided with a flange 234 at the bottom thereof. Accordingly, cyclone casing 208 may be mounted on top surface 212 by sliding flange 234 into slot 232. A deformable bead or the like may be positioned on the lower surface of flange 234 and/or top surface 212 around dirt inlet 224 so as to create an air tight seal.

Motor casing 210 may be secured to top surface 212 by any means known in the art. For example, as shown in FIG. 20, a thread 236 is provided at the lower portion of cyclone casing 208, which is mattingly received in a thread provided in the top surface of filter housing 226 and/or dirt bin 200 if filter housing 226 is not used. Filter housing 226 may be permanently mounted on top surface 212 or removably mounted thereon (such as by means of a screw thread, a slot and flange or the like). U shaped member 238 may be provided for assisting in seating filter housing 226 or motor housing 210 on spine plate 204.

Accordingly, in accordance with this aspect, the cyclone casing and the motor casing are mounted and, preferably removably mounted to spine plate 204. Accordingly, one advantage of this aspect is that the design of the vacuum cleaner may be altered by changing the cyclone casing and/or the motor casing. For example, motor casings 210*b* and 210*c* may be interchangeably usable on spine plate 204. Similarly, different cyclone casings 208*b* and 208*c* may be interchangeably usable on spine plate 204. In a particularly preferred embodiment, different sized dirt bins 200 may be utilized. Therefore, the vacuum cleaner may use a smaller dirt bin 200*c* or a larger capacity dirt bin 200*d*. Wheels 204 may be mounted directly on dirt bin 200 and/or spine plate 204.

In an alternate embodiment, it will be appreciated that filter housing 226 may comprise one or more filters and, one or more cyclones and, preferably a plurality of cyclones in parallel, for example array 246 of cyclones in parallel.

In a further alternate embodiment, it will be appreciated that dirt bin 200 may have a top which is mounted thereto. Accordingly, instead of having a spine plate, which is designed to have sufficient strength to support motor casing 210 and cyclone casing 208, the top of the dirt bin will have the required rigidity and may be permanently mounted to dirt bin 200. In such a case, as exemplified in FIGS. 21 and 22, one of sidewalls 246 may function as a door 248 for emptying dirt bin 200 or may have a door formed therein. Door 248 preferably has a deformable seal (e.g. an member that is compressed when the door is locked into position to thereby provide an airtight and, preferably, water tight container).

Figure 23:
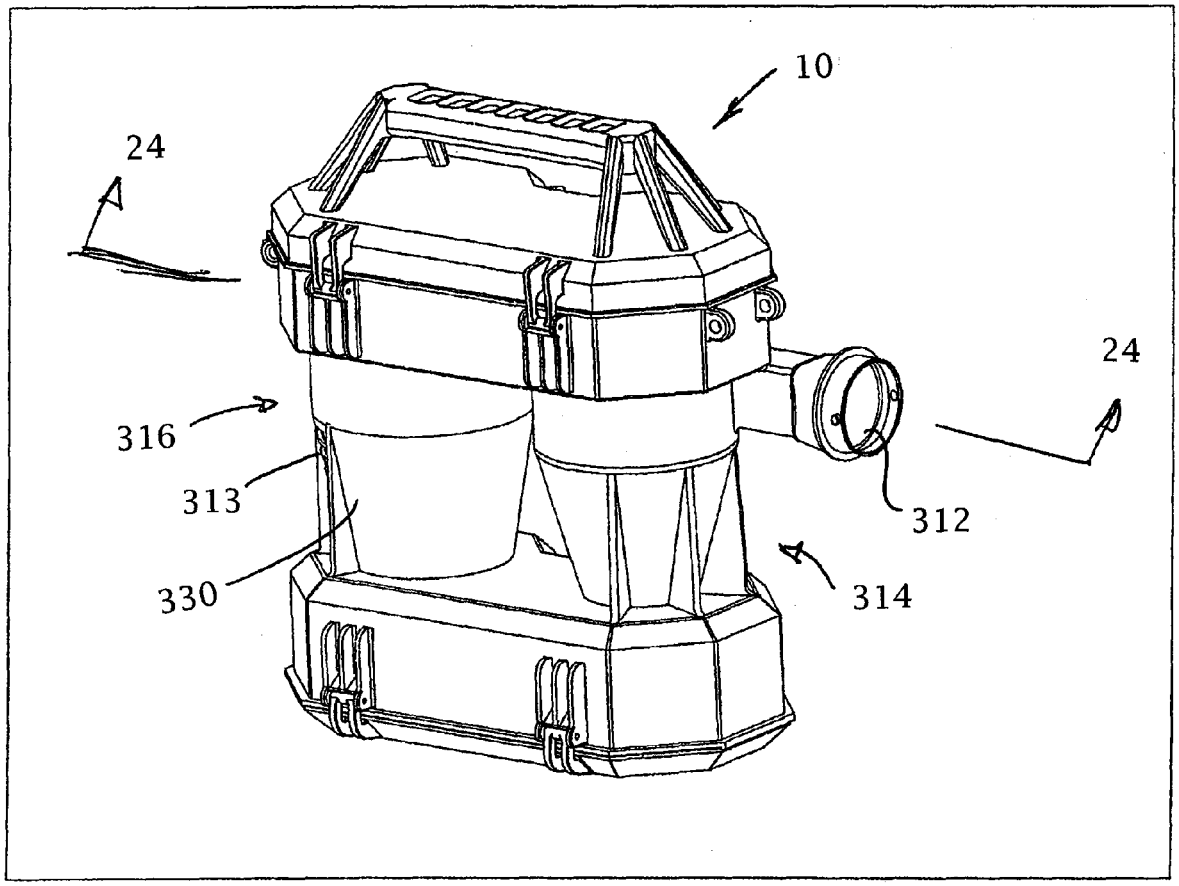
FIG. 23 is a perspective view of a sixth embodiment of a surface cleaning apparatus in accordance with the instant invention.

Another example of a surface cleaning apparatus 10 is shown in FIGS. 23 and 24. The surface cleaning apparatus 10 comprises a dirt inlet 312, an air exhaust 313, and first and second laterally spaced apart components 314 and 316, respectively, in fluid communication with the dirt inlet 312.

Referring to FIG. 24, the first component or housing 314 comprises a cyclonic cleaning stage 318 comprising a single first stage cyclone 320. In the example illustrated, the cyclone 320 extends along a first axis 322. The first component 314 has a first component width 324 corresponding to the lateral extent of the first component 314, perpendicular to the first axis 322.

The second component 316 is disposed laterally adjacent the first component 314. The second component 316 has a lateral extent 329 (measured perpendicular to the first axis 322). The first and second components 314, 316 may abut in the lateral direction, so that the overall lateral extent of the apparatus 10 is the sum of the lateral extents 324 and 329 of the first and second components, respectively. As exemplified, the upper ends of the housings may be proximate each other. It will be appreciated that they may abut and, further, they may be integrally formed. In addition, as exemplified, the housings may be conical. Therefore, the lower ends of the housings are further apart then the upper ends of the housings.

A fluid flow motor 330 is provided for drawing air through the cyclonic cleaning stage 318 from the dirt inlet 312.

In the apparatus 10, the dirt collection chamber 332 preferably extends in the lateral direction generally underneath the entire lateral extent of both the first component 314 and the second component 316.

The surface cleaning apparatus may be carried by a strap (not shown) or by using handle 360.

Referring now also to FIG. 24, the first component 314 includes a first cyclonic cleaning stage 318 and a second cleaning stage 340 disposed above and in axial registration with the first cleaning stage 320. The second cleaning stage may comprise a plurality of cyclones in parallel. In such a case, the first axis 322 of the first cleaning stage 318 (comprising a first cyclone 320) is preferably collinear with the second axis 346 of the second cleaning stage 340 (comprising a plurality of second cyclones 342 arranged in parallel). The plurality of cyclones 342 are arranged in parallel, forming a multi-cyclone assembly 344. The multi-cyclone assembly 344 has, in the example illustrated, a generally cylindrical configuration with a second axis 346. Alternately, or in addition, the additional cleaning stage 340 may include or be a filter element 356, such as a foam membrane, disposed in the fluid stream between the assembly 344 and the motor 330.

It will be appreciated that each of the features set out herein may be used individually or in combination or particular sub combination. Further, they may be used in any embodiment exemplified.

It will be appreciated that various additions and modification may be made the embodiments and each is within the scope of the following claims.

The invention claimed is:

1. A surface cleaning apparatus comprising:

(a) a dirt air inlet and a cleaned air outlet and a fluid flow path extending therebetween;

(b) at least one cyclone having a longitudinally extending cyclone axis and a suction motor having a longitudinally extending motor axis positioned adjacent the at least one cyclone wherein the longitudinally extending cyclone axis and the longitudinally extending motor axis are laterally spaced apart and generally parallel and wherein the at least one cyclone and the suction motor are part of the fluid flow path;

(c) a dirt collection chamber in communication with the at least one cyclone, the dirt collection chamber having an openable end wall; and, (d) the at least one cyclone and the entire dirt collection chamber are non-removably secured to the surface cleaning apparatus and are emptyable while connected together.

2. The surface cleaning apparatus of claim 1 wherein the at least one cyclone is provided in a first housing and the suction motor is provided in a second housing and the first and second housings are secured together.

3. The surface cleaning apparatus of claim 2 wherein the first and second housings are integrally molded.

4. The surface cleaning apparatus of claim 2 wherein the first and second housings are constructed from a transparent plastic.

5. The surface cleaning apparatus of claim 2 wherein an exterior wall of the at least one cyclone forms at least a portion of the exterior wall of the first housing.

6. The surface cleaning apparatus as claimed in claim 2 wherein the second housing includes at least one filter positioned upstream from the suction motor.

7. The surface cleaning apparatus as claimed in claim 6 wherein the filter is mounted in a filter housing and the housing is removable provided in the second housing and has handles.

8. The surface cleaning apparatus as claimed in claim 6 wherein each housing has an end portion, an air flow passage is provided from the first housing to the second housing and at least one openable door is provided on the end portions, whereby, when the door is opened, the filter is visible.

9. The surface cleaning apparatus as claimed in claim 8 wherein when the door is opened, the airflow passage is accessible.

10. The surface cleaning apparatus as claimed in claim 2 wherein the second housing further comprises a second cyclonic cleaning stage.

11. The surface cleaning apparatus as claimed in claim 10 wherein the second cyclonic cleaning stage comprises a plurality of cyclones in parallel.

12. The surface cleaning apparatus as claimed in claim 2 wherein each housing has an end portion, an air flow passage is provided from the first housing to the second housing and at least one openable door is provided on the end portions, whereby, when the door is opened, the airflow passage is opened.

13. The surface cleaning apparatus as claimed in claim 12 wherein the door has an inner surface and the airflow passage is defined as a volume between the inner surface of the door and the end portions of the first and second housings.

14. The surface cleaning apparatus as claimed in claim 12 wherein a single door closes the upper portions.

15. The surface cleaning apparatus as claimed in claim 2 wherein the first and second housings have a volume and the at least one cyclone has a volume that is at least 40% of the volume of the first and second housings.

16. The surface cleaning apparatus as claimed in claim 15 wherein the at least one cyclone has a volume that is a least 60% of the volume of the first and second housings.

17. The surface cleaning apparatus as claimed in claim 2 wherein the first and second housings are each generally vertically extending.

18. The surface cleaning apparatus as claimed in claim 2 wherein each housing has a height and the ratio of height of the first housing to the height of the second housing is from 0.6:1 to 1:0.6.

19. The surface cleaning apparatus as claimed in claim 2 wherein each housing has a height and the ratio of height of the first housing to the height of the second housing is from 0.75:1 to 1:0.75.

20. The surface cleaning apparatus as claimed in claim 2 wherein each housing has a height and the ratio of height of the first housing to the height of the second housing is from 0.9:1 to 1:0.9.

21. The surface cleaning apparatus of claim 1 wherein the surface cleaning apparatus is portable and further comprises a flexible hose positioned between a cleaning tool having the dirt inlet and the first housing and at least one of a strap and a handle.

22. The surface cleaning apparatus as claimed in claim 21 wherein the strap comprises at least one of a shoulder strap and a waist strap.

23. The surface cleaning apparatus as claimed in claim 21 further comprising a rigid conduit extending between the cleaning tool and the flexible hose, the rigid conduit having a handle.

24. The surface cleaning apparatus as claimed in claim 1 wherein the at least one cyclone has an end wall and a plate is provided in the at least one cyclone spaced from the end wall and the end wall is openable.

25. The surface cleaning apparatus as claimed in claim 24 wherein the plate is mounted to the end wall.

26. The surface cleaning apparatus as claimed in claim 1 wherein the at least one cyclone comprises a single cyclone and, a plate is provided in the first housing spaced from the openable end wall.

27. The surface cleaning apparatus as claimed in claim 1 wherein the surface cleaning apparatus is portable.

28. The surface cleaning apparatus as claimed in claim 27 wherein the surface cleaning apparatus has a carry handle for carrying the surface cleaning apparatus while the surface cleaning apparatus is in use.

29. The surface cleaning apparatus as claimed in claim 27 wherein the surface cleaning apparatus has a shoulder strap.

30. The surface cleaning apparatus of claim 1 wherein the dirt collection chamber has an openable end wall spaced from a dirt outlet of the cyclone.

31. The surface cleaning apparatus of claim 1 wherein the at least one cyclone has a dirt outlet end and the surface cleaning apparatus is emptyable from the dirt outlet end.

32. A surface cleaning apparatus comprising:

(a) a dirt air inlet and a cleaned air outlet and a fluid flow path extending therebetween;

(b) at least one cyclone having a longitudinally extending first cyclone axis;

(c) a suction motor having a longitudinally extending motor axis positioned adjacent the at least one cyclone wherein the longitudinally extending cyclone axis and the longitudinally extending motor axis are spaced apart and generally parallel and wherein the at least one cyclone and the suction motor are part of the fluid flow path, (d) an air flow passage is provided from the at least one cyclone to the suction motor, the air flow passage comprising a transverse portion and first and second opposed walls that extend in the direction of air flow through the passage; and, (e) at least one openable door comprising the first opposed wall is provided on an end of the surface cleaning apparatus, whereby, when the door is opened, the first opposed wall is moved relative to the second opposed wall such that the transverse portion of the airflow passage is opened.

33. A surface cleaning apparatus comprising:

(a) a dirt air inlet and a cleaned air outlet and a fluid flow path extending therebetween;

(b) at least one cyclone having a longitudinally extending first cyclone axis;

(c) a suction motor having a longitudinally extending motor axis positioned adjacent the at least one cyclone wherein the longitudinally extending cyclone axis and the longitudinally extending motor axis are spaced apart and generally parallel and wherein the at least one cyclone and the suction motor are part of the fluid flow path, (d) an air flow passage is provided from the at least one cyclone to the suction motor, the air flow passage having first and second opposed walls that extend in the direction of air flow through the passage; and, (e) a door closes an end of the surface cleaning apparatus, whereby, when the door is opened, the first opposed wall is moved and the second opposed wall remains in position such that the airflow passage is opened.

34. A surface cleaning apparatus comprising:

(a) a dirt air inlet and a cleaned air outlet and a fluid flow path extending therebetween; and, (b) a first housing comprising at least one cyclone and having a longitudinally extending first cyclone axis and a dirt container associated with the at least one cyclone;

(c) a suction motor having a longitudinally extending motor axis positioned adjacent the at least one cyclone wherein the longitudinally extending cyclone axis and the longitudinally extending motor axis are spaced apart and generally parallel and wherein the at least one cyclone and the suction motor are part of the fluid flow path; and, (d) the first housing has an end attached to the first housing and a plate mounted to the end is provided in the first housing spaced from the end and the end of the first housing is openable while positioned adjacent to the suction motor.

35. A surface cleaning apparatus comprising:

(a) a dirt air inlet and a cleaned air outlet and a fluid flow path extending therebetween; and, (b) a first housing comprising at least one cyclone and having a longitudinally extending first cyclone axis and a dirt container associated with the at least one cyclone;

(c) a suction motor having a longitudinally extending motor axis positioned adjacent the at least one cyclone wherein the longitudinally extending cyclone axis and the longitudinally extending motor axis are spaced apart and generally parallel and wherein the at least one cyclone and the suction motor are part of the fluid flow path; and, (d) the first housing comprises a single cyclone, a dirt collection chamber, and an openable end wall, and the end wall of the first housing is openable when the entire dirt collection chamber is positioned adjacent to the suction motor.

36. A surface cleaning apparatus comprising:

(a) a dirt air inlet and a cleaned air outlet and a fluid flow path extending therebetween; and, (b) first and second housings positioned side by side, the first housing comprises at least one cyclone having a dirt collection chamber, the dirt collection chamber having a pivotally openable end wall and the at least one cyclone has an exterior wall and the second housing comprises a suction motor and has an exterior wall wherein the at least one cyclone and the suction motor are part of the fluid flow path;

wherein the first and second housings are non-removably secured in position with respect to each other and the surface cleaning apparatus has an absence of a housing inhibiting opening of the end wall of the dirt collection chamber.

37. The surface cleaning apparatus of claim 36 wherein the first and second housings are integrally molded.

38. The surface cleaning apparatus of claim 36 wherein the first and second housings are constructed from a transparent plastic.

39. The surface cleaning apparatus of claim 36 wherein the at least one cyclone has an exterior wall that forms at least a portion of an exterior wall of the surface cleaning apparatus and the exterior wall of the second housing forms at least part of the outer wall of the surface cleaning apparatus.

* * * * *

UNITED STATES PATENT AND TRADEMARK OFFICE

CERTIFICATE OF CORRECTION

PATENT NO. : 8,146,201 B2
APPLICATION NO. : 11/828694
DATED : April 3, 2012
INVENTOR(S) : Wayne Ernest Conrad It is certified that error appears in the above-identified patent and that said Letters Patent is hereby corrected as shown below:

1. Column 16, line 55, "wherein the at least one cyclone has a volume that is a least" should read --wherein the at least one cyclone has a volume that is at least--.

Signed and Sealed this
Third Day of July, 2012

David J. Kappos

David J. Kappos
*Director of the United States Patent and Trademark Office*